United States Patent [19]

Basic, Sr.

[11] Patent Number: 5,007,353

[45] Date of Patent: Apr. 16, 1991

[54] INCINERATOR IMPROVEMENTS

[76] Inventor: John N. Basic, Sr., 41 W. 202 Whitney Rd., St. Charles, Ill. 60174

[21] Appl. No.: 60,761

[22] Filed: Jun. 1, 1987

Related U.S. Application Data

[63] Continuation-in-part of Ser. No. 659,849, Oct. 9, 1984, Pat. No. 4,706,578, which is a continuation of Ser. No. 362,853, Mar. 29, 1982, Pat. No. 4,475,469, which is a continuation-in-part of Ser. No. 248,054, Mar. 27, 1981, Pat. No. 4,438,705.

[51] Int. Cl.[5] ..... F23B 5/00; F23C 9/00; F23G 5/06

[52] U.S. Cl. ..... 110/212; 110/211; 110/213; 110/214; 110/231; 110/345; 110/346; 422/182

[58] Field of Search ..... 110/211, 212, 213, 234, 110/346, 345, 214; 422/182

[56] References Cited

U.S. PATENT DOCUMENTS

| | | | |
|---|---|---|---|
| 3,664,277 | 5/1972 | Chatterjee et al. | 110/212 |
| 3,797,415 | 3/1974 | Young, Jr. et al. | 110/212 |
| 4,356,778 | 11/1982 | McRee, Jr. | 110/212 |
| 4,674,417 | 6/1987 | Hoskinson | 110/212 X |

*Primary Examiner*—Edward G. Favors
*Attorney, Agent, or Firm*—Eugene F. Friedman

[57] ABSTRACT

Improvements for an incinerator system including double reburn tunnels, an excitor within a reburn tunnel, a choker for closing off part of a reburn tunnel, a grate near the incinerator's inlet to permit the drying and initial combustion of refuse, an ash scoop which remains out of the water during most of its operation. The use of dual reburn tunnels, along with a damper that permits the closure of at least one of them, permits the efficient and environmentally acceptable utilization of the main incinerator chamber even with minimal refuse contained there. With less refuse, only one reburn unit operates; it will still have sufficient heat and throughput to maintain, with minimal auxiliary fuel, the temperatures needed for complete combustion. An excitor, or solid stationary object placed within the reburn tunnel, permits the retention and reflection of the heat generated by the burning to assure complete combustion of all hydrocarbons within the reburn unit. Additionally, the air utilized in the reburn unit may enter through the excitor for the efficient distribution and concomitant combustion.

279 Claims, 11 Drawing Sheets

Fig. 7
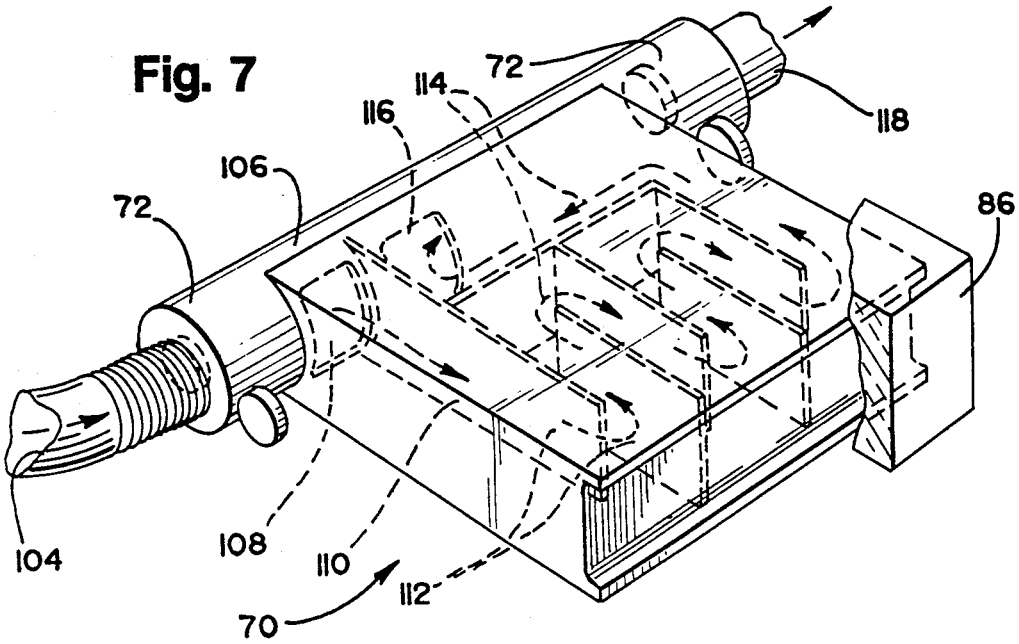
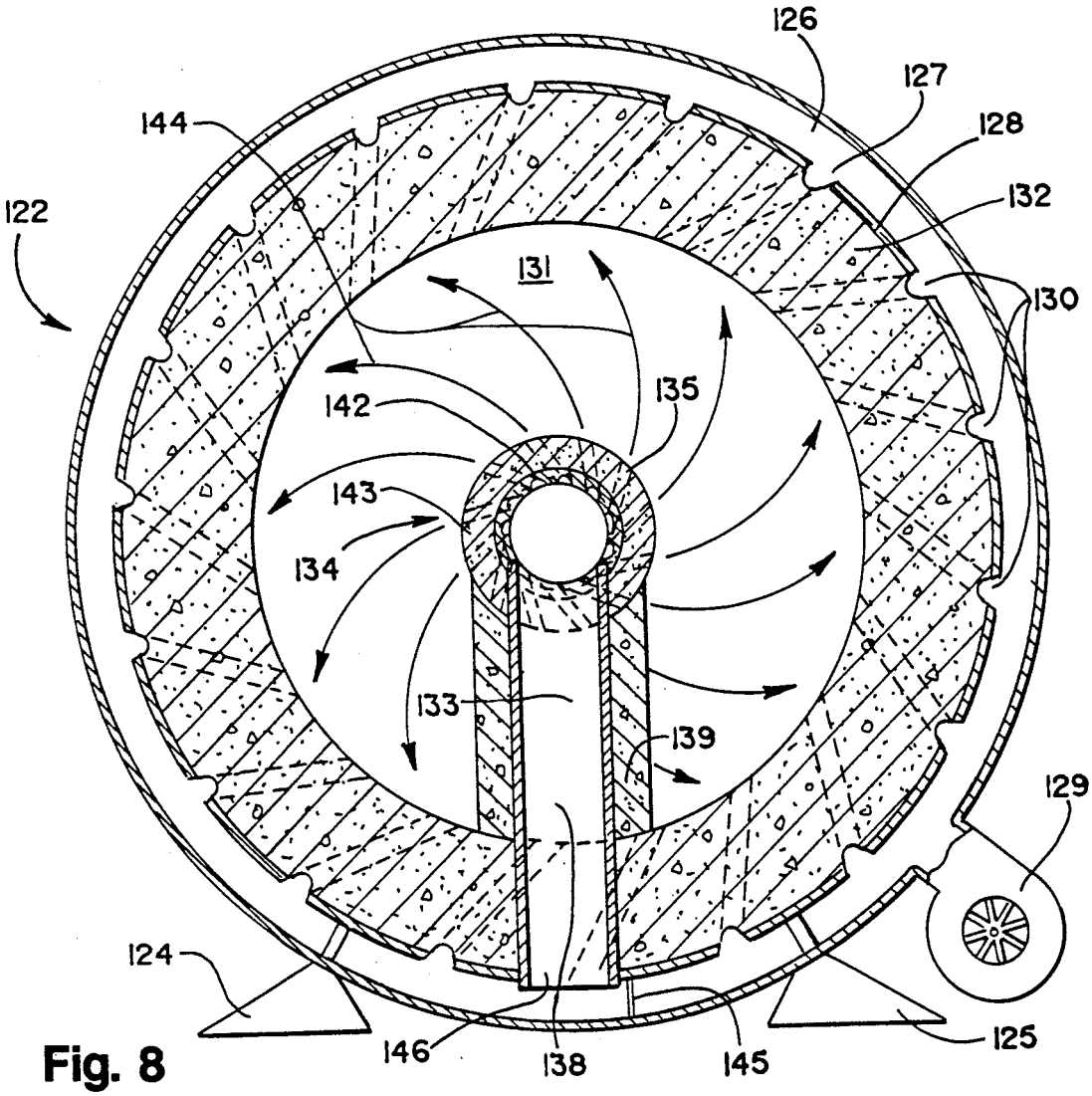
Fig. 8

Fig. 20
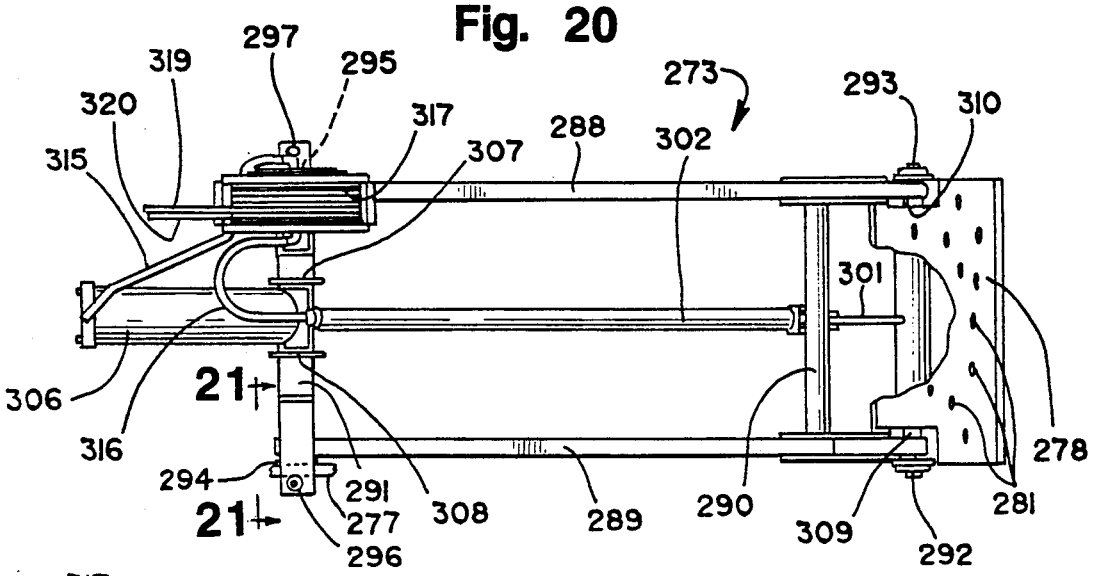
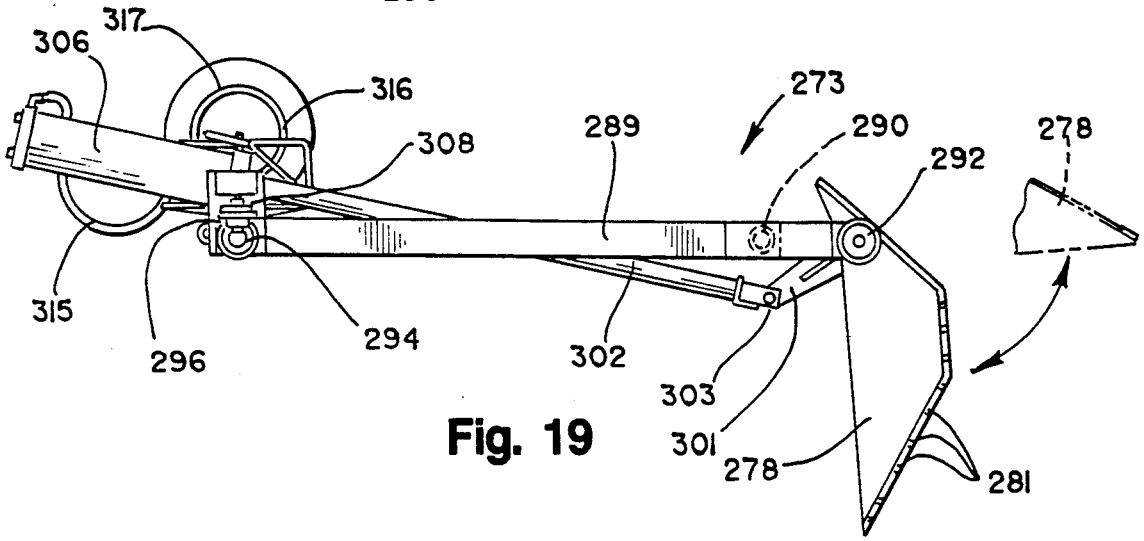
Fig. 19
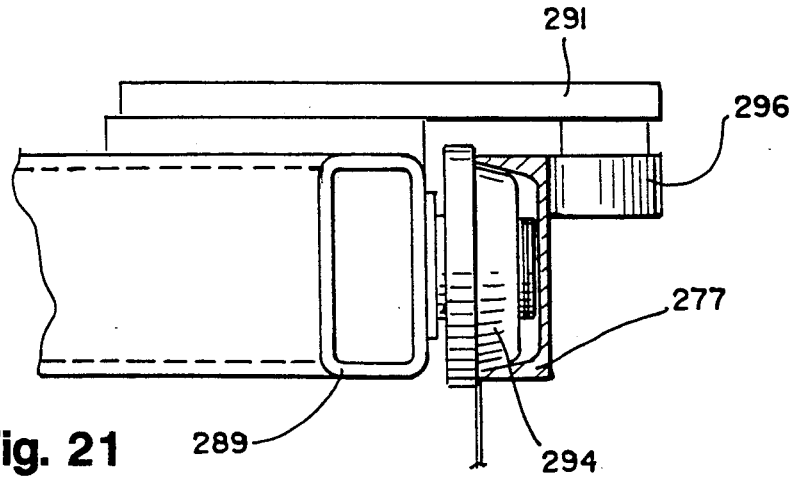
Fig. 21

Fig. 24
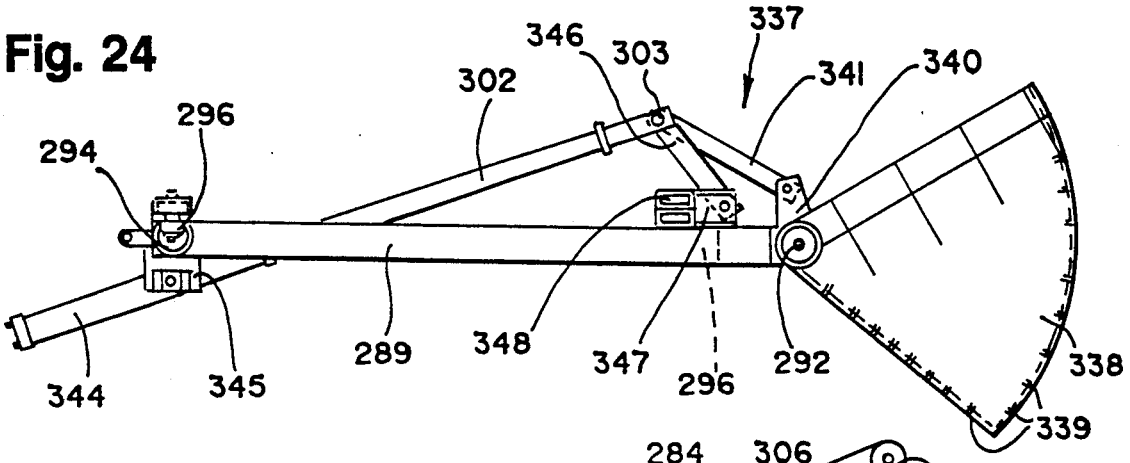
Fig. 23
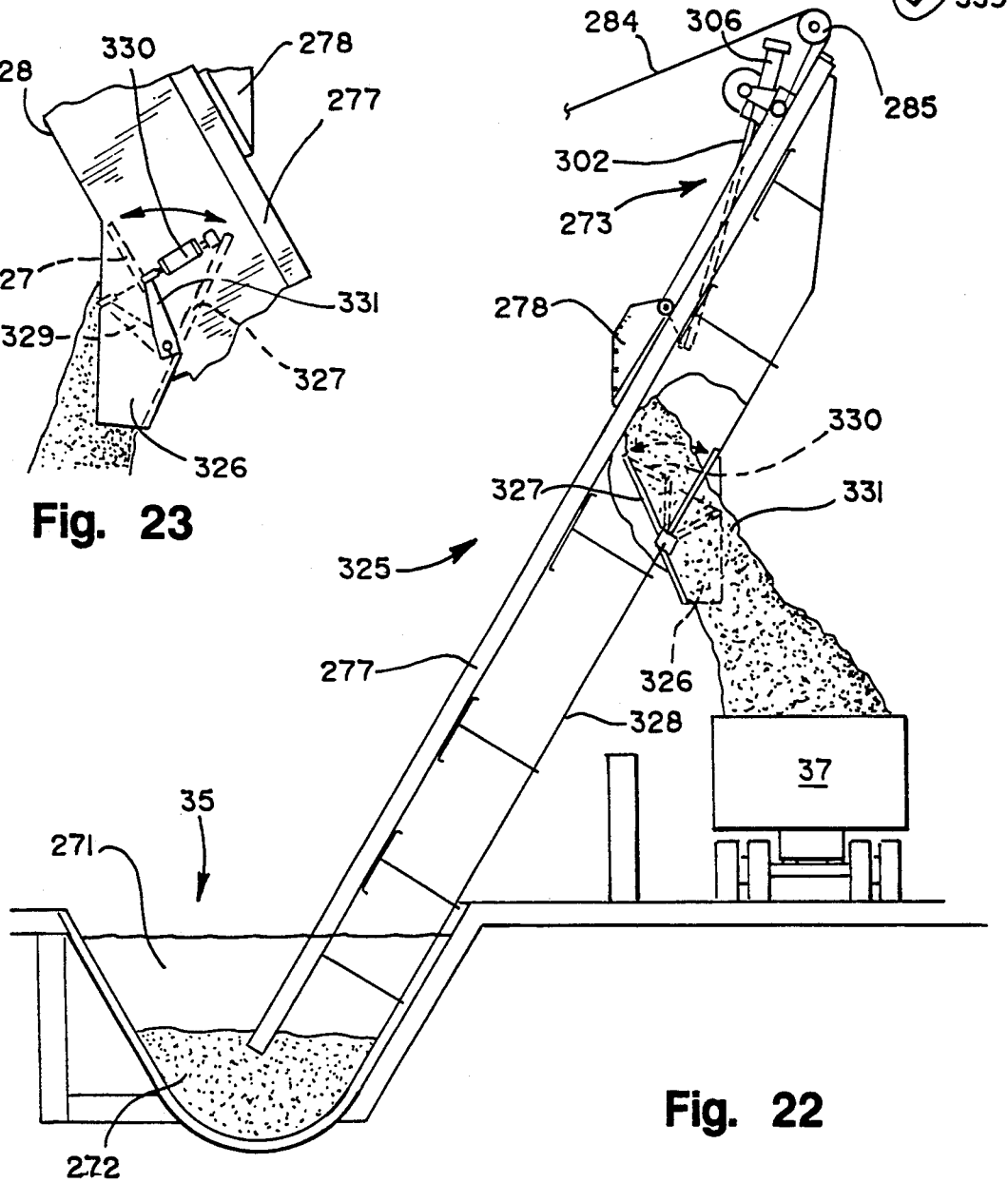
Fig. 22

INCINERATOR IMPROVEMENTS

CROSS-REFERENCE TO RELATED APPLICATIONS

The present application constitutes a continuation-in-part of U.S. patent application Ser. No. 659,849 filed Oct. 9, 1984, U.S. Pat. No. 4,706,578 which itself represents a continuation of U.S. patent application Ser. No. 362,853 filed Mar. 29, 1982, now U.S. Pat. No. 4,475,469, which in turn constitutes a continuation-in-part of U.S. patent application Ser. No. 248,054 filed Mar. 27, 1981, now U.S. Pat. No. 4,438,705.

BACKGROUND

John N. Basic, Sr., in his U.S. Pat. Nos. 4,438,705 issued on Mar. 27, 1984, and 4,516,510 issued on May 14, 1985, both entitled "Incinerator With Two Reburn Stages and, Optionally, Heat Recovery", provided an incinerator system and techniques that very significantly advanced the art of incinerating refuse. The disclosures provided equipment and methods for taking waste of vastly different descriptions, heat contents, and wetness and, within one type of equipment, incinerating them in an environmentally acceptable manner. These disclosures merit a careful understanding and are incorporated by reference.

Not only do Basic's two patents provide a complete incinerator system for burning refuse in bulk or hydrocarbon liquids, they also provide equipment and techniques for incinerating hydrocarbon-containing fumes from sources which may produce them. Again, they accomplish this result without substantial deleterious effect upon the environment.

Naturally, in a system as complex as that shown by Basic in his two patents, a consideration of the various components by a creative mind can suggest and lead to improvements and further developments that can improve the efficiency of the system. Thus, for example, Basic's U.S. Pat. No. 4,475,469, issued on Oct. 9, 1984, discloses, in conjunction with the above two patents, an improved hearth floor which moves under the influence of impulses to urge the burning debris along from the inlet of the main chamber to the ash outlet. This pulsating hearth developed by Basic represents a significant improvement on the major advances disclosed in his two incinerator patents referenced above.

Austrian patent No. 317,401 to Bent Faurholdt, published on Aug. 26, 1974, introduces air into a reburn tunnel through a pipe placed on the middle of that tunnel itself. However, Faurholdt suggests no use for his pipe other than introducing the air into the tunnel. Furthermore, introducing the air through perforations in the pipe results in a "T" configuration for the velocity components of the gases. This may even result in the air thus introduce resisting the flow of gases through the reburn tunnel.

Accordingly, the present invention provides additional improvements to an incinerator system that will increase its efficiency. At the same time, the system will have the ability to reach operating temperatures prior to the introduction to refuse and with the expenditure of only minimal amounts of auxiliary fuel. Additionally, in general, the developments provide greater ease in the utilization of an incinerator system.

SUMMARY

Typically, a fume burning system improves the environmental quality of a gaseous fluid emanating from the output of some source. That source will contain combustible hydrocarbons. The fume burning system should include a reburn unit having an inlet opening coupled to and in fluid communication with the output of the source of the fluid. The reburn unit also includes an outlet opening for the egress of the gaseous products of combustion from it. Additionally, it should have a burner, coupled to the unit, which burns the fuel inside of the reburn unit. This has the purpose of maintaining the temperature at a level that insures the complete burning of the combustible hydrocarbons. To further permit the burning, the reburn unit includes oxygenating means coupled to it. This component introduces an oxygen-containing gas into the reburn unit to support combustion.

One improvement of this type of a fume burner involves splitting the reburn unit itself into first and second reburn sections. Basically, they each represent a twin of the other and either can accomplish the functions without the other operating at all.

To permit the use of two separate reburn sections, the inlet opening to the reburn unit includes first and second inlet ports coupled to and in fluid communication with the output of the hydrocarbon source. The first and second inlet ports open into the first and second reburn sections respectively.

Similarly, the outlet opening includes first and second outlet ports. These represent the outlets for the first and second reburn sections, respectively.

Further, the burner and the oxygenating means each includes first and second sections. The first section for these two components couples to the first reburn section while the second section of these components couples to the second reburn section. In each of the two reburn sections, the burner section and the oxygenating means performs their functions of burning a fuel and introducing the oxygen-containing gas.

As an entirely separate improvement, the reburn unit whether or not composed of two sections, may include an excitor placed within, surrounded by, and coupled to the reburn unit. The excitor, as a minimal purpose, in effect reduces the cross-sectional area through which the oxygen-containing gas must travel to reach the combustible hydrocarbons. Furthermore, it provides a reflective surface which will permit the heat either entering or generated within the reburn unit to reach the gaseous molecules to further encourage complete combustion.

Within the reburn unit, the majority of the length of the excitor, in passing from the reburn's inlet to the reburn's outlet, should remain out of contact with wall of the reburn unit. The excitor has the purpose of reducing the cross-sectional area on planes transverse to the path passing from the inlet opening to the outlet opening of the reburn unit.

The excitor, in this configuration, may serve to introduce the oxygen-containing gas into the reburn unit. It does so with nozzles, in fluid communication with the oxygenating mechanism and having an arrangement on the surface of the excitor. The nozzles introduce the air into the space between the inner surface of the reburn unit and the excitor and does so at a nonperpendicular angle to the direction of the path from the inlet to the outlet of the excitor. By thus avoiding the "T" configuration, the air entering the reburn unit through the nozzles will aid the turbulence of the gas without retarding or blocking its progress.

However, the excitor need not introduce the air or other oxygen-containing gas into the reburn unit to have an important and useful function. It may remain passively within the reburn unit to reflect the heat generated or introduced there. This will maintain the gases at an elevated temperature in which they will undergo their efficient and thorough combustion. To accomplish this, the surface of the excitor facing the interior of the reburn should have a composition of a heat and corrosion resistant material. This precludes its destruction at the temperatures and in the gaseous environments at which the reburn unit operates.

Stated alternately, the excitor should not absorb and pass the heat from the reburn unit into its interior. Rather, it should have a relatively low thermal conductivity to effectuate the reflection of the heat from its surface back into the gases undergoing combustion. As a convenient limit, the surface of the excitor facing the interior of the reburn should have a composition of a material with a thermal conductivity constant k less than about $$\frac{60 \text{ Btu. in.}}{\text{hr. ft.2 °F.}}$$

where k is defined by $$k = \frac{gl}{AT}$$

where q is the heat conductivity in Btu/Hr. through a surface of thickness 1 in inches, area A in square feet, and temperature T in degree F.

Whether with or without twin reburn sections or an excitor, a fume burner, when having a low input of gaseous fluid, may operate more efficiently when it permits a lower throughput of gases. To accomplish this objective, the fume burner may include a choking device coupled to its outlet opening to selectively reduce the cross-sectional area of this outlet opening. This will retain the gases within the reburn unit for a sufficient period of time to accomplish full combustion even though it has a minimal input. This may also find use upon the initial commencement of operation of the unit after it has cooled down and before introducing refuse. The unit can then reach operating temperature where it avoids environmental pollution. Reversing the damping effect and permitting the return unit's outlet opening to revert to its full size then allows the system's normal operation.

Rather than merely operating as fume burners, the components given above may form part of an integrated incinerator system. In this instance, in addition to the reburn unit with whatever improvements of those given above it may incorporate, the incinerator system will also include a main combustion chamber having an inlet for the introduction of solid bulk refuse. An outlet opening from the main chamber permits the egress of the gaseous products of combustion from there. The outlet opening from the main combustion chamber then couples to and displays fluid communication with the inlet opening of the reburn unit.

The method of burning fumes utilizing twin reburn tunnels involves passing the fumes from an output of a source directly into the inlet openings of first and second reburn sections. To maintain a desired temperature, the process will generally require burning a fuel in these two reburn sections. In order to promote the combustion of the gases, an oxygen-containing gas must be introduced into the reburn sections. Lastly, the gaseous combustion products within the reburn sections pass out through outlet openings.

To effectuate combustion with an excitor does not necessitate, of course, twin reburn sections. Rather, the fumes emanating from the output of a source pass into the inlet opening of a reburn unit. While there, they pass around an excitor placed within, surrounded by, and coupled to the reburn unit. The majority of the length of the excitor, passing from the reburn's inlet to its outlet, remains out of contact with the wall of the reburn unit.

To maintain the proper temperature, typically a fuel undergoes burning within the reburn unit. Then, as before, an oxygen-containing gas must enter the reburn unit to achieve combustion of the hydrocarbons. The oxygen-containing gas enters the space between the inner surface of the reburn and the excitor at a nonperpendicular angle relative to the direction of the flow of the gas in that space. Finally, the gaseous combustion products pass out of the reburn unit.

As an alternate aspect, the burning of fumes proceeds in a reburn unit as generally indicated above. The combustion of fuel in that unit maintains the desired temperature. Introducing the oxygen-containing gas permits the combustion of the fumes as required. The area of the outlet opening through which the gaseous combustion products pass out of the reburn unit may be selectively reduced in order to maintain the temperature in the unit at the desired level with the addition of minimal or no auxiliary fuel.

The burning of refuse according to these developments delineated above requires, in addition to the procedures discussed above for fume burning, the placing of refuse through an inlet opening into a main incinerator chamber. There, the bulk refuse burns to produce gaseous combustion products. These combustion products pass out of the main combustion chamber through an outlet opening and directly into an inlet opening of the reburn unit.

An improved burning may result for particular types of refuse where the main incinerator chamber has a grate device located above the floor of the main chamber in close proximity to the inlet opening. The grating device should hold the refuse for a limited period of time after its introduction through the inlet opening. Subsequently, the grate device allows the refuse to drop through, while continuing to burn, to the floor of the main chamber.

The use of an auxiliary grate of this fashion may prove propitious for various types of refuse including material having a large content of moisture or with a large amount of high Btu combustibles. In the former instance, the retention of the refuse for a brief period of time on the grate allows it to dry before it drops to the chamber floor. Otherwise, maintaining the fire in the desired condition might prove more difficult.

With the high Btu refuse, maintaining it on the grate allows a portion of it to volitalize and begin to burn at relatively high temperatures. When the remainder drops through the grate, it has a lower temperature and thus would have less of a propensity to induce slagging on the chamber floor.

The method of burning refuse to obtain this advantage involves placing it through an inlet opening into an enclosed main chamber of an incinerator system and, specifically, onto a grate located within the main chamber. A fire-resistant floor sits below the grate. The process continues with the partial burning of the refuse while on the grate.

While the refuse continues to burn, it is then placed, generally through dropping, onto the chamber's floor. Finally, the burning of the refuse continues while it sits on the floor.

Often, the burning of the refuse in the incinerator produces ashes dumped into a pit filled with water. The water, in fact, provides a seal between the environment on the inside of the incinerator and that of the room on the outside. These ashes must undergo removal from time to time to avoid filling the pit.

An improved device for removing the ashes from the pit includes first an elongated track having its first end located in proximity to the pit. The second end lies further away and at a higher level than the first end.

A scooping device moves along the track and displays first and second configurations. In the first configuration, it holds onto the ashes while, in the second, it releases whatever ashes it may be holding.

An elevator moves the scoop device along the track until it reaches a first position near the first end in the pit. In this position, the scoop itself sits in the water in the pit.

The elevator can then move the scoop to a second position near the other end of the track. At this location, the scoop sits entirely out of the water of the pit.

Lastly, a control device couples to the scoop. The controller moves the scoop, when at the first location inside the pit, from the second to the first of the configurations. This allows the scoop to actually grab onto ashes and other debris within the pit.

When at the second, or elevated, position, the controller causes the scoop to move from the first to the second configurations. As a result, the scoop releases the ashes it may have held. Typically, the ashes will then fall into a bin or truck.

The removal of the ashes or other debris from the pit commences by moving the scoop downward along the track until it reaches the first end located in proximity to the pit. The downward movement of the scoop then stops.

The scoop then changes its configuration so that it may retain the debris in the pit. While remaining in the configuration to retain the debris, the scoop moves upward along the track and out of the pit. While out of the pit, the scoop changes from the first to the second configuration in which it drops the ashes at an appropriate location.

BRIEF DESCRIPTION

FIG. 1 gives a perspective view of an incinerator system installation.

FIG. 2 presents a top plan view of a reburn unit having two separate reburn tunnels with each tunnel having two seperate reburn stages.

FIG. 3 provides a side elevational view of the reburn unit shown in FIG. 2 and also shows further stages for processing the exaust gases.

FIG. 4 gives a cross-sectional view of the twin reburn tunnels of FIG. 3 along the line 4—4.

FIG. 5 provides a close-up view, partially in section, of the damper that can serve to close off either or even both of the twin reburn tunnels of FIGS. 1 to 4.

FIG. 7 illustrates a damper that can serve to close off the inlet opening to either the twin reburn tunnels or partially block the outlet openings.

FIG. 8 gives a cross-sectional view of a reburn tunnel having an excitor inside where air enters through both the reburn unit's wall and the excitor's wall.

Figure 9:
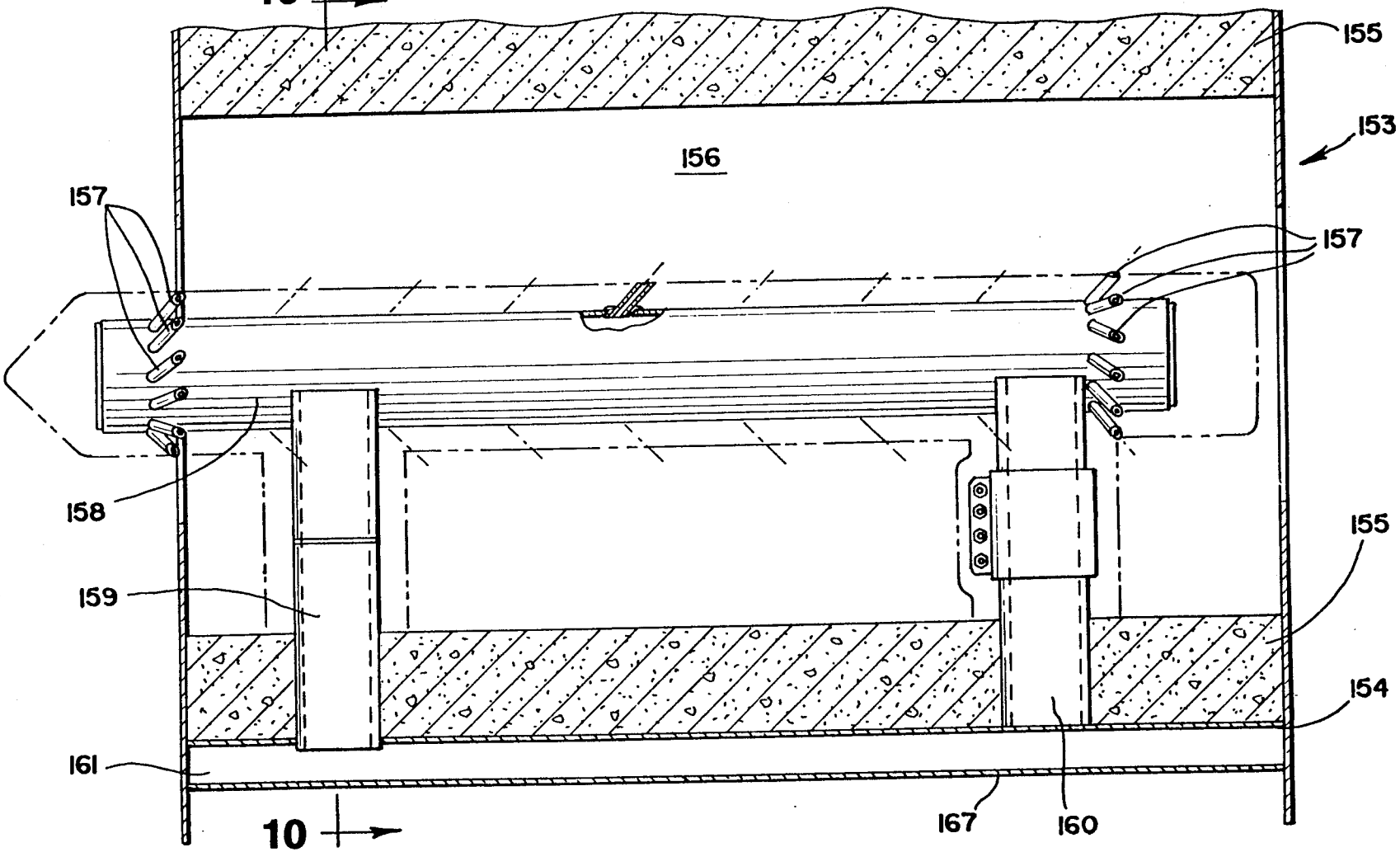

FIG. 9 provides a side cross-sectional view of a portion of a reburn tunnel having an excitor inside in which air enters the reburn tunnel through nozzles placed only on the excitor.

Figure 10:
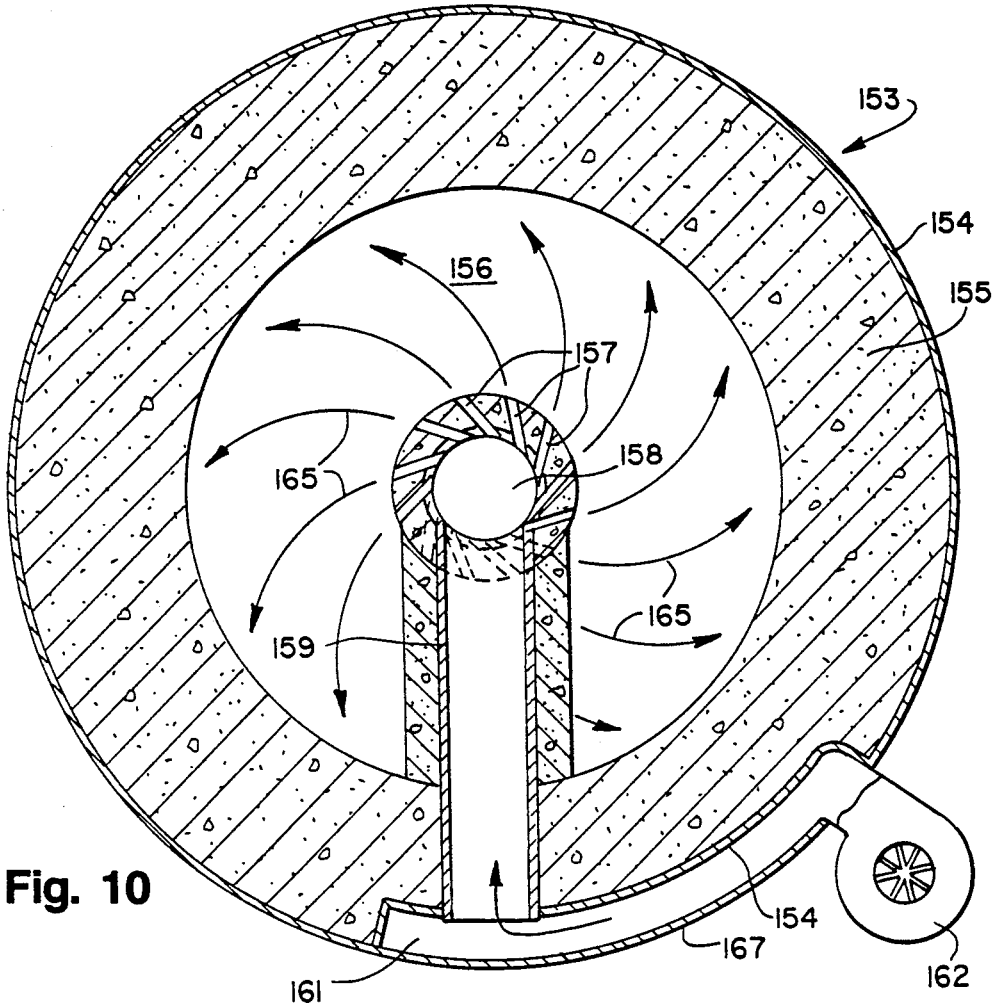

FIG. 10 gives a cross-sectional view along the line 10—10 of the reburn tunnel shown in FIG. 9.

FIGS. 11 to 15 provide diagramatic cross-sectional views of reburn tunnels with excitors showing, in particular, different techniques for increasing the cross-sectional areas of the reburn tunnels in going from the inlet opening to the outlet opening.

Figure 16:
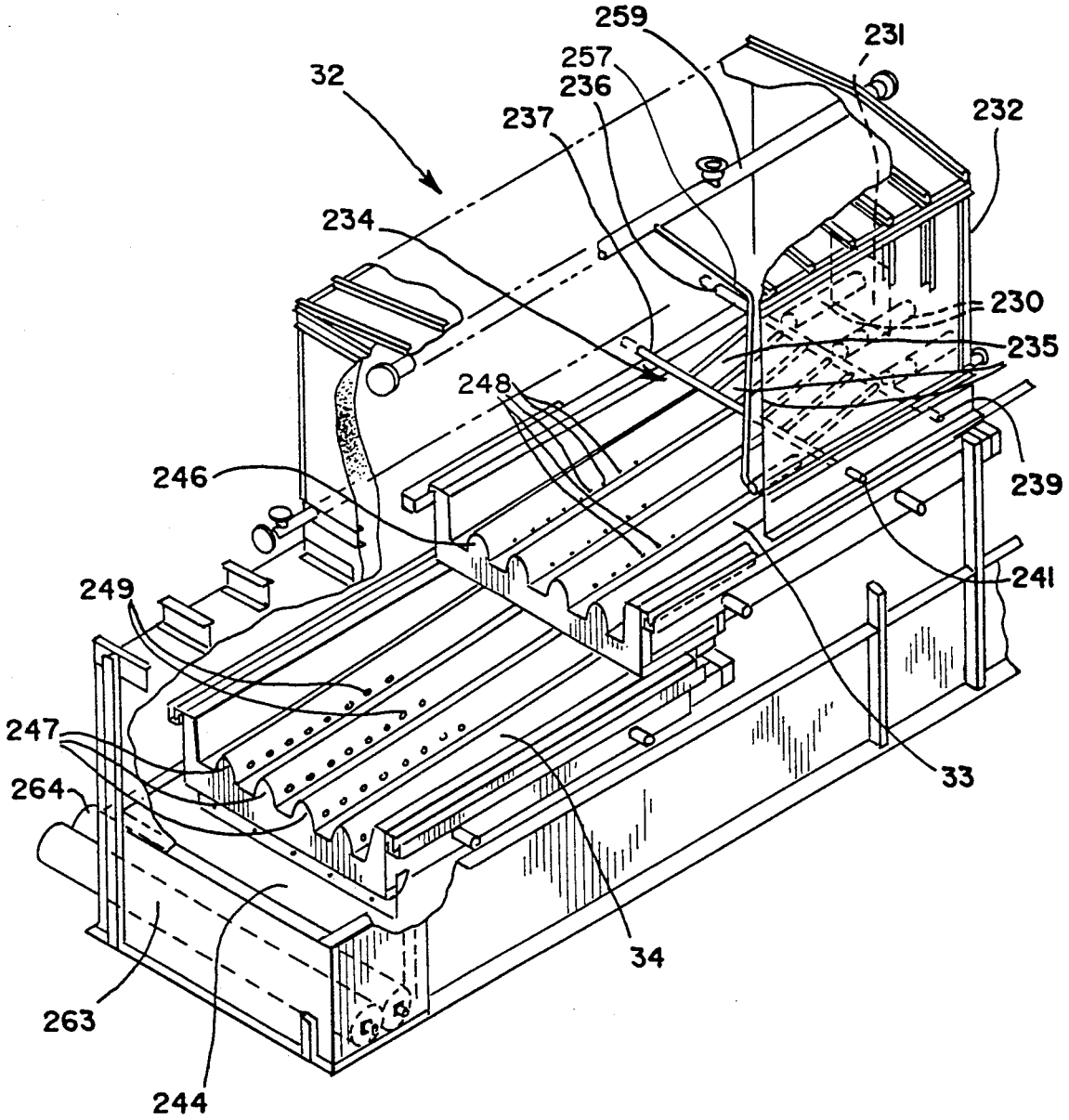

FIG. 16 gives an isometric view, partially in section, of an incinerator main chamber having a grate in the vicinity of the inlet opening to the chamber but located above the chamber's floor.

Figure 17:
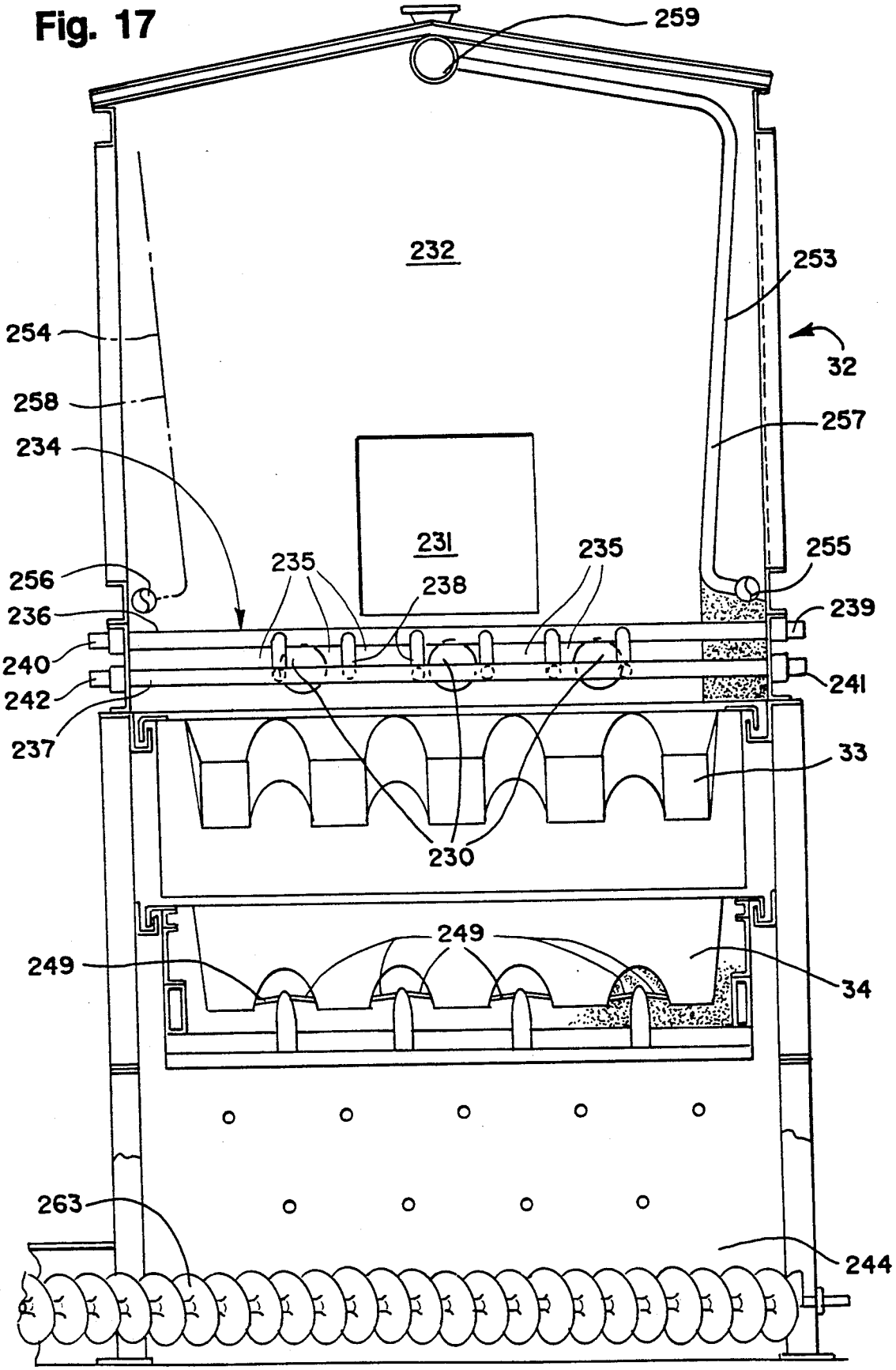

FIG. 17 displays an end view, in cross section, of the incinerator chamber of FIG. 16.

Figure 18:
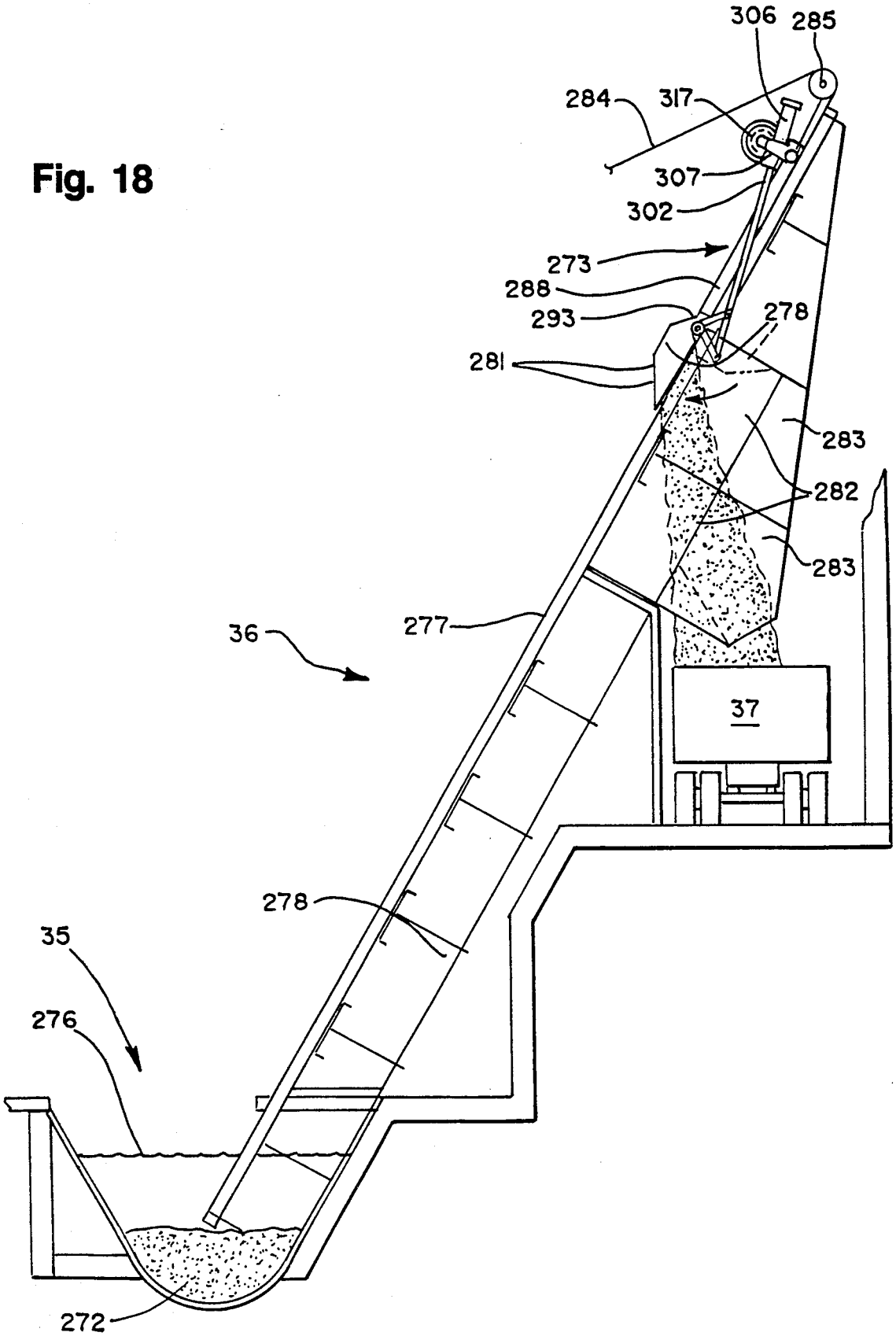

FIG. 18 provides a side elevational view of a scoop mechanism for removing ashes from the output pit of an incinerator system.

FIG. 19 gives a side elevational view of an ash scoop used in the mechanism of FIG. 18.

FIG. 20 displays a top plan of the scoop of FIG. 19.

FIG. 21 gives an end elevational view along the line 21—21 of the track guide of the scoop of FIG. 20.

FIG. 22 illustrates a side elevational view of yet a further alternate ash removal mechanism.

FIG. 23 provides an enlarged view of the chute mechanism shown in FIG. 22.

FIG. 24 gives a side elevational view of an alternate ash removal scoop for use in the mechanisms shown in FIGS. 18, 22, and 23.

DETAILED DESCRIPTION

Figure 1:
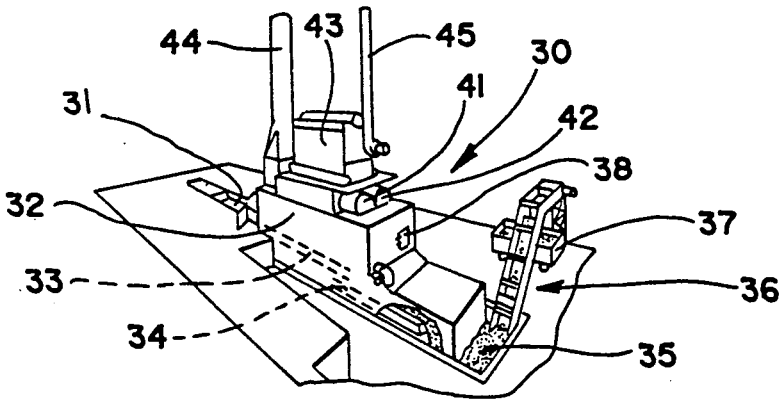

FIG. 1 shows an incinerator system generally at 30. Bulk refuse or hydrocarbon-containing liquids enters the incinerator 30 through the loader 31 and enters the main chamber 32. During most of its stay in the incinerator 30, solid refuse remains upon the pulsating hearth floors 33 and 34. Upon the completion of combustion, the remaining ash falls into the pit 35 where the removal mechanism designated generally at 36 lifts it and places it in the truck 37. The door 38 permits access to the interior of the main chamber 32 for the usual maintenance.

The gases produced by the combustion within the main chamber pass through the dual reburn tunnels 41 and 42 and through the further treating, recirculation, and heat removal stages 43. They eventually leave through the stack 44. Heat recovered from the incinerator system 30 may pass into the pipe 45.

Figure 2:
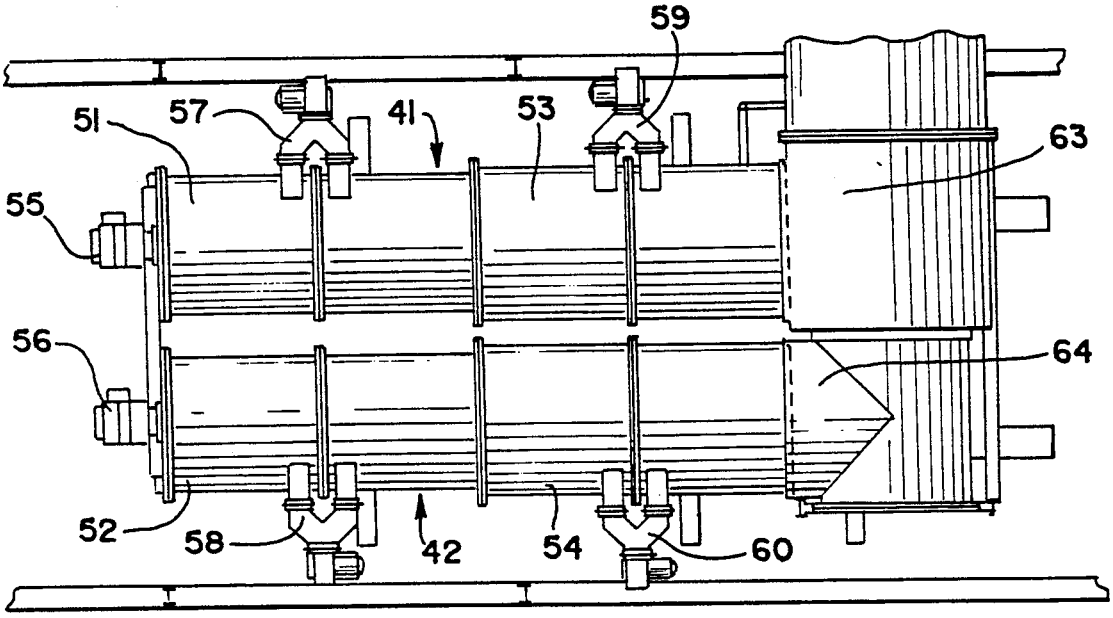
Figure 3:
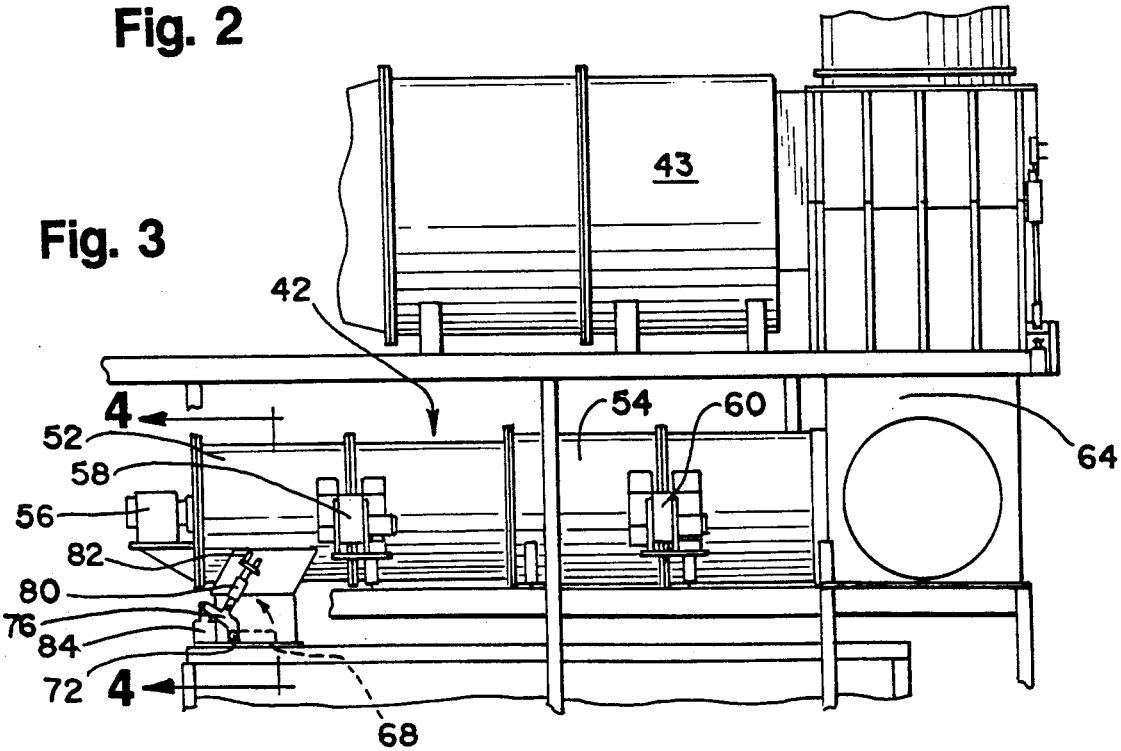

In FIGS. 2 and 3, the reburn tunnels 41 and 42 include the respective first reburn stages 51 and 52 and respective second reburn stages 53 and 54. The burners 55 and 56 at the beginning of the first stages 51 and 52 maintain the temperatures in the tunnels 41 and 42 at the desired levels for proper operation. They also bring the reburn temperatures up to the proper levels at the each commencement of operation. In fact, environmental regulations often require that the incinerator achieve its operating temperatures prior to the introduction of the first amount of refuse whatsoever after a shut-down. The burners 55 and 56 assist in this task.

The blowers 57 and 58 provide air to the first stages 51 and 52 for combustion and the blowers 59 and 60 perform the same function for the second stages 53 and 54. The gases from the second stages 53 and 54 pass through the outlets 63 and 64.

As observed, the second reburn stages 53 and 54 have greater cross-sectional areas than the first reburn stages 51 and 52 of the tunnels 41 and 42, respectively. This allows the second reburn stages 53 and 54 to accommodate the greater volumes of gases resulting from the introduction of air and from the combustion of volitalized hydrocarbons within the tunnels 41 and 42. This represents one method of increasing the volume of the reburn tunnels from their inlets to the outlets. Other techniques accomplishing the same objective receive discussion below with reference to FIGS. 11 to 15.

After leaving the second stages 53 and 54, the gases then pass to the subsequent treating section 43 and mentioned above.

Figure 4:
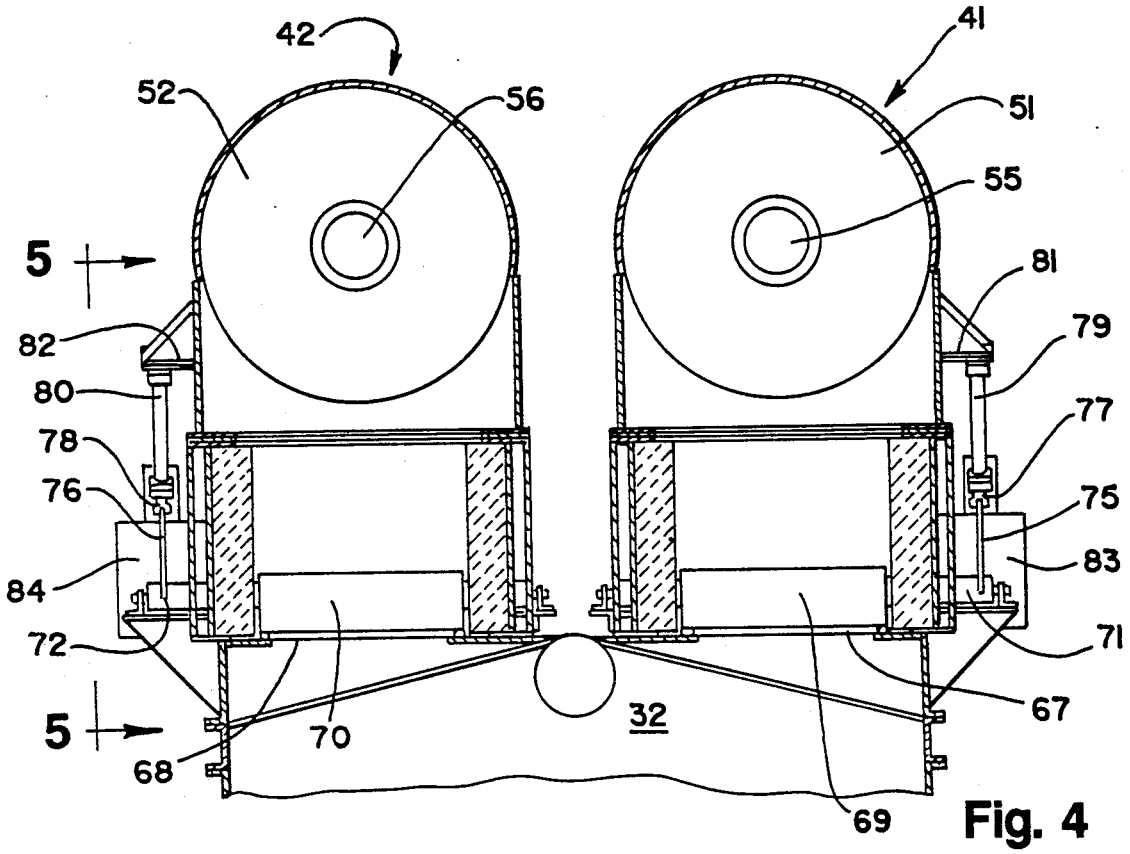
Figure 5:
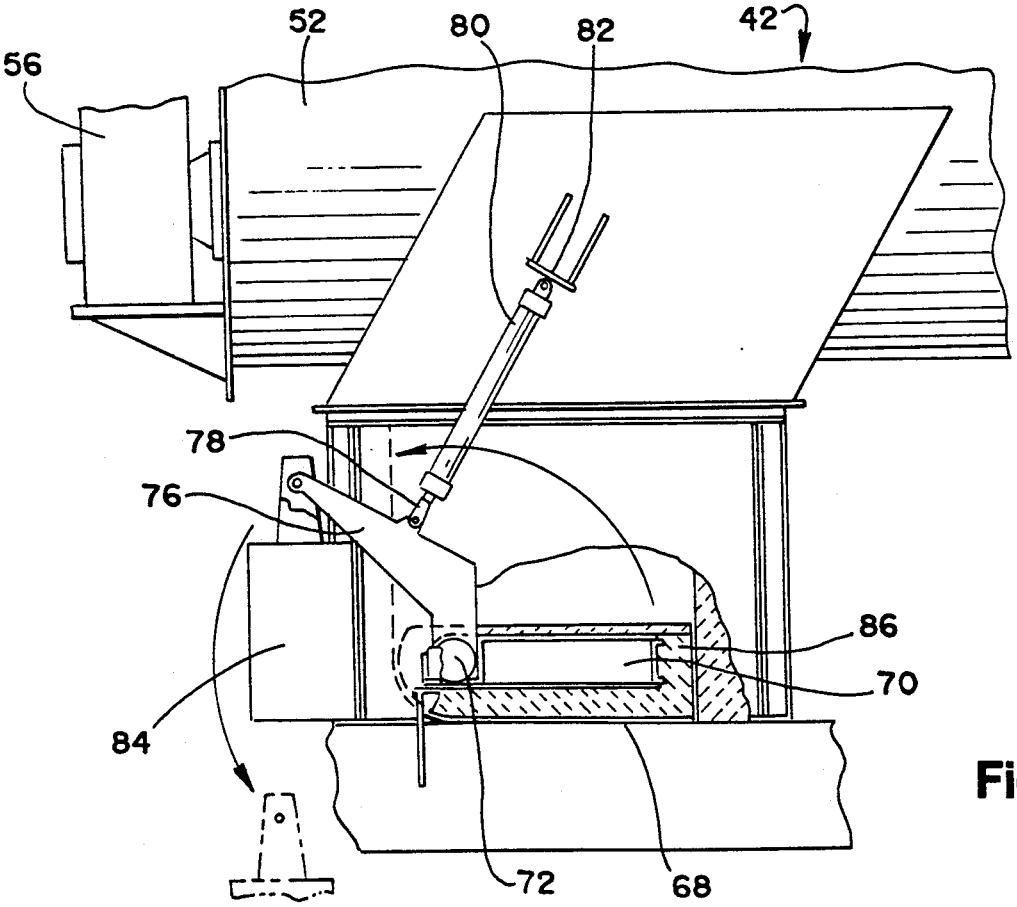

As seen in FIGS. 4 and 5, the gases from the main chamber 32 pass through the outlet openings 67 and 68 which also form the inlet openings to the reburn units 41 and 42, respectively. The dampers 69 and 70, when in the positions shown in FIGS. 3 to 5, cover the opening 67 and 68, respectively, and close them off. In operation, of course, at least one of the dampers 69 and 70 will remain open. When the main chamber 32 has sufficient combustible material inside, both will open and allow the gases to pass through to the reburn tunnels 41 and 42.

To accomplish their motion, the dampers 69 and 70 include the axial extensions 71 and 72. The lever arms 75 and 76 then connect ridgedly to the extensions 71 and 72. The rods 77 and 78 connect the lever arms 75 and 76 to the pistons 79 and 80 which attach ridgedly at their other ends to the brackets 81 and 82. The extension of the pistons 79 and 80 in FIGS. 3 to 5, especially the last, will induce the rotation of the lever arm 76 and its counterpart not shown about the center of the axis 72 to result in the opening of the dampers 69 and 70.

The counterweights 83 and 84 rotationally coupled to the other ends of the lever arms 75 and 76. They counterbalance the weight of the dampers 69 and 70 and facilitate their controlled motion.

A significant part of the weight of the dampers 69 and 70 results from their having a covering of the refractory 86 as shown in FIG. 5. This, of course, provides protection against the high temperatures and corrosiveness of the gases passing around them.

To help further protect the damper 69 and 70, they include air channels as discussed below with reference to FIG. 7. The passage of air through the dampers 69 and 70 keeps them at a low enough temperature to prevent their destruction.

Figure 6:
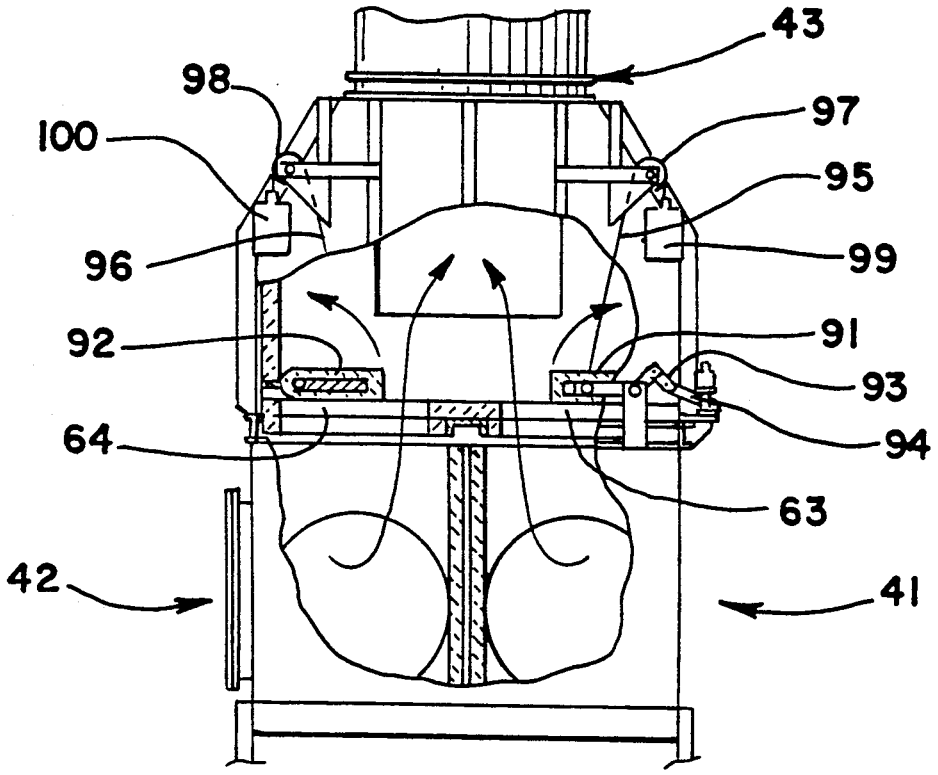
FIG. 6 shows the outlet openings of the twin reburn tunnels and the choke dampers which can partially close each of the outlet openings.

Similarly, the dampers 91 and 92 cover the outlet opening 63 and 64 of the reburn tunnels 41 and 42, respectively. As shown in FIG. 6, however, the dampers 91 and 92, even when in the closed position as shown there, only cover up to about a maximum of about 60 percent of the outlet opening 63 and 64. When closed, they retain the gases within the reburn tunnels 41 and 42 for a longer time to assure their complete combustion. Typically such retention becomes desirable when the tunnels 41 and 42, and often, the main chamber 32, operate upon substantially less than the maximum amount of refuse or combustion gases than the system can handle.

The dampers 91 and 92 operate independently of each other depending upon the conditions in the respective reburn tunnels 41 and 42. They may, for example, submit to the control of temperature sensors placed within their respective tunnels. A lowering temperature may indicate the need to close the appropriate damper to retain the heat within the respective tunnel. Alternately, when the incinerator system produces steam, the damper control may measure the steam pressure produced by the system. A declining steam pressure may indicate a smaller quantity of heat within the system. This would provide an indication that either or both of the dampers 91 and 92 should close at least to some extent.

The dampers 91 and 92 in FIG. 6 not only have the totally open or totally closed positions. They may also occupy intermediary locations to effectively block the outputs 63 and 64 by an amount less than the maximum closure that the dampers can achieve.

The movement of the damper 91 appears in FIG. 6 under the action of the lever arm 93 connected to the piston 94 which effectuates the desired movement between opening and closing. The cable 95 attaches to the damper 91, passes over the pully 97 and connects to the weight 99 to counter-balance the weight of the damper 91. Only the cable 96, the pully 98, and the weight 100 appear in FIG. 6 for the tunnel 42.

The choke dampers 91 and 92 serve to retain the gas within the reburn tunnels 41 and 42 for a greater period of time. In other words, it slows down the passage of the gas through these chambers. To achieve the desired combustion, the gas speed should typically not exceed about 55 feet per second. To assure proper combustion, the gas should move no faster than about 46 feet per second.

The dampers 91 and 92, as shown, take the form of rectangular blocks that pivot to open and close. Alternately, as square blocks, they may slide sideways into the position where they partially close the outlet openings 63 and 64. They reopen them by sliding sideways in the opposite direction. In fact, they may even slide through an opening in the exterior wall of the incinerator system for this purpose.

As a further alternate, the choke dampers at the ends of the reburn tunnels 41 and 42 may take the form of butterfly valves. This would give them either a round or rectangular configuration located within the outlets of the reburn units. They would then pivot about their centers to partially close or open the reburn's outlets. In the latter configuration, they would remain within the opening but present their edges of minimal area to avoid substantial interference with the passage of the gases.

FIG. 7 shows a typical damper, for example, the closure 70 to the outlet opening 68 to the second reburn tunnel 42 seen in FIG. 5. In FIG. 7, a supply of air passes through the damper 70 to keep its temperature from rising to a point where it could suffer serious damage from the heated environment from which it operates. As seen from FIG. 5, the ends of the axial extensions 72 sit on the outside of the tunnel 42.

The extensions 72 have hollow interiors which permits the passage of gas through them. To provide the cool gas, the flexible tube 104 connects to the nearer axial extension 74 to provide a source of cool gas. The cool gas travels through the interior of extension 72 into the axis 106 and out the opening 108 into the chamber 110. It then follows a path created by the dividers 112 and indicated by the arrows 114. Eventually it reaches the opening 116 in the axis 106 where it passes out through the other axial extension 72 and in it to the flexible tube 118.

FIG. 18 shows a reburn tunnel generally at 123 which may serve as either of the sections 51 or 53 of the reburn tunnel 41 or the sections 52 and 54 of the reburn tunnel 42. The tunnel 123 sits generally on the supports 124 and 125. The outer skin 126 surrounds the tunnel 123 and forms the plenum 127 in conjunction with the wall 128. The blower 129 places air in the plenum 127 under pressure. From there, the air may pass through the nozzles 130 which take it into the interior 131 of the reburn tunnel 123. The refractory 132 covers the interior wall 128 and the nozzles 130 to protect them from the heat and the corrosive environment of the interior 131 of the tunnel 123. Additionally, the air within the plenum 127 may pass through the support 133 and into the excitor 134 located in the tunnel's interior 131. From there it passes through the nozzles 135 and into the interior 131 where it helps support combustion.

The support 133 itself includes the inner wall 138 generally having a metalic composition. The refractory 139 surrounds the wall 138 to protect it from the tunnel's environment. Conveniently, the support 133 may have a rectangular cross section on planes parallel to the surface on which the tunnel sits. This will provide it with maximum cross-sectional area for the amount of the interference in the gas flow in the tunnel that it creates.

Similarly, the excitor 134 protects its inner metal wall 142 from corrosion and heat damage with the refractory covering 143. The nozzles 135 pass through the refractory 143.

As seen in FIG. 8, air leaving the nozzles 135 does so with a tangential component of velocity. In other words, the nozzles 135 make an angle with the radii from the center of the excitor 134. Forty five degrees represents a desirable angle.

The gas emanating from the nozzles 135 with the tangential component of velocity follows the path generally shown by the arrows 144. This tangential movement of the air causes it to efficiently and effectively mix with the combustible gases contained in the tunnel's interior 131. Further, the nozzles 135 as well as the outer nozzles 130, will generally introduce the air with an axial component of velocity. In other words, the nozzles point downstream. The velocity of the gases leaving the nozzles may in fact make a 45 degree relative to the axial, or downstream, direction.

Additionally, the nozzles 135 may appear on the excitor 134 in rows in passing from the inlet to the outlet. To further assist the creation of the desired turbulence within the interior 131, the nozzles may have a staggered configuration from row to row to provide a more even air supply and turbulence.

The construction shown in FIG. 8 may undergo modifications for different purposes. Thus, plugging the nozzles 130 will result in all of the air from the plenum 127 passing around the wall 128, through the support 133, into the excitor 134, and out of the nozzles 135 into the tunnel's interior 131. This appears to have a beneficial effect in creating the turbulence necessary for combustion.

Additionally, placing a barrier at the location 145 between the outer wall 126 and the plenum wall 128 will cause the air from the blower 129 to pass around substantially all of the plenum 127 before it reaches the inlet 146 to the support 133. This will have the effect of cooling the wall 128 with the air prior to its introduction into the interior 131. Furthermore, warming the air helps maintain the temperature inside the tunnel 123 at the necessary levels for combustion.

Alternately, the excitor 134 may have no nozzles on it whatsoever. In this eventuality, all the air entering the tunnel's interior 131 will pass through the nozzles 130 on the reburn unit 123 itself. Nonetheless, the excitor must still have some air passing through it from one support to the other. This provides a cooling effect to prevent the heat within the reburn tunnel 123 from destroying the excitor 134.

With or without nozzles, the excitor 134 serves additional purposes. The heat created within the interior 131 of the tunnel 123 itself helps to support the combustion of the gases inside. The heat near the middle of the interior 131 will pass into the refractory surface 143 of the excitor 134. From there it will radiate back into the interior 131 where it will help excite combustion.

To provide the reradiation of heat absorbed, the wall of the excitor 134 should permit very little of the heat to pass through. Thus, it should have a low thermal conductivity constant k, generally less than about 60. Preferably, the conductivity constant k, as defined above, will not exceed about 24.

Furthermore, the air entering the interior 131 must create turbulence in order to accomplish combustion. The excitor 134 reduces the maximum dimension of the space in the interior of the tunnel 123. Thus, air entering the interior 131 has a much shorter distance to travel to reach the combustible gasses. Thus it can more effectively create the required turbulence for combustion because of the presence of the excitor 134.

Desirably, the space between the outer surface of the refractory 143 of the excitor 134 and the inner surface of the refractory 132 covering the outer wall 128 should remain constant all around the excitor 134. This permits the most efficient mixing and turbulence of the oxygen introduced into the tunnel's interior 131. In the case of a circular reburn tunnel as shown in FIG. 8, this would result in the interior 131 assuming an annular configuration.

In the case of an incinerator system with a single reburn tunnel, a single excitor would obviously suffice. For a system having twin reburn tunnels as shown in FIGS. 1 to 6, either or both of the tunnels may include an excitor. The latter, of course, represents the most desired configuration.

FIG. 9 shows generally a portion of a reburn tunnel 153 which may, in fact, represent part of either of the reburn tunnels 41 or 42. The outer wall 154 includes the refractory covering 155 but no nozzles passing through it. Rather, all of the air entering the interior 156 of the tunnel 153 passes through the nozzles 157 on the excitor 158. That air, as before, enters the excitor 158 through its supports 159 and 160 and, eventually from the plenum 161. As seen in FIG. 10, the blower 162 provides the air under pressure which eventually passes through the nozzles 157 into the interior 156.

As before, the nozzles 157 introduce the air with an axial component of velocity. Stated in other words, the air is introduced at least partially in the direction from the inlet of the reburn section 153 to the outlet, or in the direction from the first support 159 towards the second support 160. As in FIG. 9, that angle generally amounts to about 45 degrees.

Furthermore, as shown in both FIGS. 9 and 10, the nozzles impart a tangential as well as a radial component of velocity to the air passing through them. Again, the nozzles will introduce the air at an angle of about 45 degrees relative to the radial direction. Thus, half of the non-axial velocity of the gases will move them outward and the other half moves them around the interior 156. The result appears in FIG. 10 where the arrows 166 show the general vorticity to the direction of movement of the air.

Figure 11:
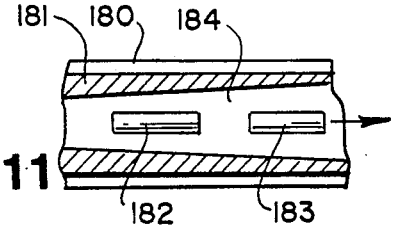

The plenum 161 does not extend the entire circumference of the reburn tunnel 153. Rather, it only goes from the blower 162 to the support 159. The outer wall 167, along with the wall 154 attached to the refractory 155, creates the plenum 161. FIG. 11 gives a diagram of a section of a reburn tunnel having the outer wall 180, the refractory 181 and the two excitor sections 182 and 183. The arrow indicates the direction of the gas movement as in FIGS. 12 to 15. The excitors 182 and 183 have the same, constant cross-sectional area. However, the cross-sectional area of the interior 184 increases in the direction of the gas movement because the refractory wall 181 slopes outward. This permits the reburn section to accommodate the increasing amounts of air introduced either through the wall 181 or the excitors 182 and 183. In FIG. 11, the cross-sectional area of the interior 184 increases gradually because of the gradual slope of the refractory wall.

Figure 12:
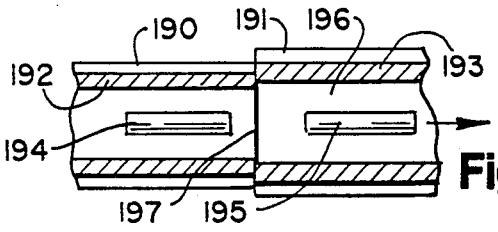
Figure 13:
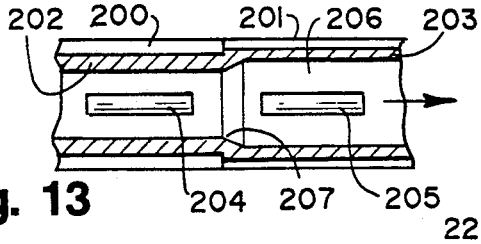

In FIG. 12 appears another reburn section. It too has the outer wall 190 and 191, the refractory 192 and 193, and the excitor sections 194 and 195. As shown there, the interior 196 experiences a sharp, discontinuous increase at the juncture 197. This may, for example, represent the juncture between two separate reburn stages as shown in FIGS. 2 and 3 and discussed above.

FIG. 13 again shows a reburn section having the outer wall 200 and 201, refractory sections 202 and 203 and excitor sections 204 and 205. There, the interior volume 206 increases gradually at the juncture 207 between the two sections. However, the sloping wall at the juncture 207 results in less adding another undesired turbulence than the very sharp discontinuity 197 shown in FIG. 12.

Figure 14:
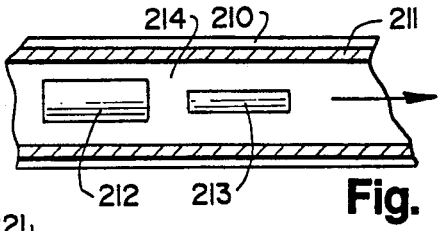

Another reburn section appears in FIG. 14 and includes the outer wall 210, the refractory 211, and the excitor sections 212 and 213. The smaller cross-sectional area of the excitor 213 as compared to the excitor 214 results in an increase in the cross-sectional area 214 of the interior as the gas travels from the excitor 212 to the excitor 213.

Figure 15:
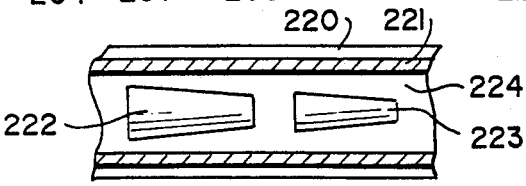

Finally, FIG. 15 shows the reburn section with the walls 220 and 221 and the excitor sections 222 and 223. The conic shape of the excitor sections 222 and 223 results in a gradual increase of the volume of the gas as it passes across them in the interior 224.

The initial combustion of the refuse, of course, takes place in the main chamber 32 as seen in FIGS. 16 and 17. The screw feeders 230 may assist in the introduction of particulate refuse such as rice hulls. More typically, bulk refuse enters through the opening 231 in the forewall 232. In any event, the bulk refuse entering the incinerator 32 sits upon the grate generally at 234. It will rest there briefly to permit combustion to commence.

If the refuse has a high moisture content, it may undergo drying while it rests upon the grate 234 to permit its more facile subsequent burning. If, upon enterring, it immediately sat upon the hearth 33, it would experience greater difficulty in drying in order to undergo subsequent combustion.

Alternately, a very high Btu content material such as plastics may burn at very high temperatures. If this occurred on the floor 33, the uneven heating could cause slagging of the floor itself.

Thus, the refuse sits upon the grate 234, for a limited period of time. However, the majority of the fixed hydrocarbons within the material should remain unburned when the refuse slips through or off the grate 234 and onto the floor 33. The volatile hydrocarbon content may well have, by this time, already entered the gas stream.

As shown in FIGS. 16 and 17, the grate 234, to permit the refuse to fall to the floor 33, will include the holes 235 passing through it. The size of the openings of the holes 235 generally lies in the range of 12 to 18 inches. This permits most types of refuse to fall through to the floor prior to the burning of the majority of the fixed hydrocarbons.

The grate 234, of course, exists in the heated and corrosive environment of the main chamber 32. Thus, it should generally have some mechanism for cooling it to prevent its destruction by heat or corrosion. To effectuate this result, the grate 234 includes the hollow longitudinal pipes 236 and 237 and the cross pipes 238. The pipe 236 has the couplings 239 and 240 while the pipe 237 includes the couplings 241 and 242. This permits the passage through it of a fluid which will effectuate the cooling of the grate 234. The fluid thus introduced may take the form of air, water, steam or oil.

Additionally, the pipes 236 to 238 of the grate 234 will have a refractory coating to provide further heat protection. Lastly, a wear surface composed typically of face hardened refractory will help protect the grate 234 from abrasion due to the refuse placed upon it.

The floor 33 may assume a number of forms. A particular and advanced type of pulsed hearth floor appears in Basic's U.S. Pat. No. 4,475,469 mentioned above. Other types of floors may work also, displaying various degrees of desirability.

Thus, for example, the floor 33 may simply be form of a stationary hearth. Some form of a ram or other pusher would then typically move the refuse along until it burned into ashes which would then fall into an appropriate collector. Often, however, the floor will experience some form of movement to assist the burning refuse in traveling from the inlet to the outlet of the main chamber 32.

The floor 33 may often constitute a hearth, whether moving or stationary. Experience indicates that the former represents the preferred technique. The pulsating hearth, whether in the configuration shown in Basic's patent or otherwise has proved most efficient. In Basic's patent, the hearth experiences arcuate movement, in pulses, in the direction from the inlet 231 toward the outlet. It moves more rapidly in the former direction than the latter in order to toss the refuse along almost in a snow-shovel type movement.

The hearth floor 33 shown in FIG. 16 has a shape that has proved beneficial in the burning of many types of refuse. Here, the floor inclines from the inlet 232 to the outlet ash pit 244. This slight lean built into the upper floor 33 and the lower floor 34 assists the refuse in moving in response to any motion experienced by the floors.

Additionally, the floors 33 and 34 include the ridges 246 and 247, respectively, on their upper surfaces. This helps channel and shuffle the refuse sitting there to aid in its combustion. The jets 248 on the upper floor 33 and 249 on the lower floor 34 provide under-fire air to assist combustion to the burning refuse.

As shown in FIG. 17, the nozzles 249, as do the nozzles 248 of the upper floor 33, the lower floor 34, incline downwards as they introduce the air into the main chamber 32. This downward angle on the nozzles 249 and 248 helps prevent the entrance of particles of refuse into them which could result in their clogging.

The amount of air introduced through the nozzles 248 and 249 may vary depending upon the conditions within the incinerator system in general in the main chamber 32 in particular. Thus, as discussed above, the system may contain insufficient refuse to operate at or near capacity. Introducing in this case less air through these jets, may assist the entire incinerator system to reach or remain at its proper operating temperature.

Instead of the hearth floors 33 and 34, the main chamber 32 could include a grate floor underneath the grate 234. The refuse would fall from the upper grate to the lower grate and then undergo its full combustion. This lower grate may then either remain stationary or experience some type of movement to transfer the burning refuse in the direction of the ash pit 244.

This may work in conjunction with utilization of the choke dampers 91 and 92. One method of accomplishing the reduction of the air in the main chamber would simply involve turning off the air introduced in the second pulsating hearth floor 34.

The main chamber 32 includes the membrane sidewalls 253 and 254 which appear diagramatically in FIGS. 16 AND 17. In these walls, the water passes through the lower inlet pipes 255 and 256. From there it passes through the tubules 257 and 258 of the membrane walls 253 and 254 to the header pipe 259. From there it may travel elsewhere to provide useful energy in the form of steam for electricity, heating, or other purposes.

As discussed above, the main chamber may not have sufficient refuse to support the heat throughout the incinerator system. In this eventuality, the amount of heat taken out through the header 259 may suffer a reduction in order to leave sufficient heat within the main chamber and reburn tunnels to maintain the temperatures required for clean and efficient burning.

The ash pit 244 of the main chamber 32 includes the screw feeders 263 and 264. These remove ashes from the pit 244. However, as with other ash removal systems such as the chain drag system, the moving components of the screw feeders 263 and 264 sit under the water and in the ash pit where any repair proves difficult. A significantly improved type of ash removal system appears in FIGS. 18 to 25.

The ash pit 35 appears at the bottom of FIG. 18. Typically, it will contain water 271 and the ashes 272 at the bottom. The water 271, of course, provides a seal between the interior of the main combustion chamber and the room atmosphere.

Naturally, from time to time the ashes 272 must undergo removal from the pit 35. To accomplish this objective, the scoop mechanism shown generally at 273 descends along the track 277 until the scoop 278, in the configuration shown in solid lines in FIG. 18, enters the water 271 and digs into the ash heap 272. It then reverts to its carrying configuration shown in dashed lines in FIG. 18 while remaining at the bottom of the pit 272. This allows the scoop 278 to capture a portion of the ashes 272.

The scoop mechanism 273 then rises along the track 277. Desirably, it will stop shortly after lifting the scoop 278 itself out of the water 271. The water entrained with the ashes 272 will then have an opportunity to drain through the openings 281 in the bottom of the scoop 278. The back of the track 277 forms a trough 278 which will guide the dripping water back into the pit 35.

When the mechanism 273 has returned to its elevated position as shown in FIG. 18, the scoop 278 moves from its holding configuration shown in dashed lines to its release configuration shown in solid lines. The ashes then fall from the scoop 278 through the opening 282 in the trough 278 and into the truck 37 or other container. The side guards 283 keep the ashes from splattering outside of the truck 37.

The scoop mechanism 273 moves upward and downward under the influence of the cable 284. At one end, the cable 284 attaches to a typical winch which winds up and releases the cable 284 depending upon the winch's controls. In turn, the cable 284 passes over the pully 285 and attaches to the scoop mechanism 273. When the winch unwinds the cable 284, the latter passes over the pulley 285 and allows the scoop mechanism 273 to descend into the pit 35. When the winch winds up the cable 284, it pulls on the scoop mechanism 273 dragging it out of the water and up the track 277.

The scoop mechanism, or trolley, 273 appears in greater detail in FIGS. 19 and 20. The trolley 273 first consists of the rigid frame formed by the runner bars 288 and 289, and the front crossbar 290 and the rear crossbar 291 rigidly adhered to the runner bars 288 and 289. The front wheels 292 and 293 and the rear wheels 294 and 295 ride inside of the track 277 as shown in FIG. 21. Further, the horizontal guide wheels 296 and 297 press against the tracks 277 from the outside of the rear wheels 294 and 295, respectively. This assures proper alignment of the trolley 273 on the track 277.

The arrangement of the guide wheels 296 and 297 has a further advantage in considering the use of the trolley 273 in removing ashes from the pit 35. Specifically, the rear wheels 294 and 295 riding inside of the track members 277 and the guide wheels 296 and 297 pressing against the side of the track members 277 largely orient the scoop mechanism 273 on the track 277. When the cable 284 allows the scoop 278 to descend into the pit 35, only the front end of the trolley 273 actually enters the water 271. The rear of the trolley 273, including the wheels 294 to 297, remain at all times outside of the water 271.

Thus, the wheels which must make intimate and proper contact with the track 277 to primarily orient the trolley 273 remain out of the water which could cause it to corrode or become impeded by debris within the water.

Keeping the rear of the trolley 273 out of the water has further advantages with regards to controlling the configuration of the scoop 278. The scoop 278 includes the ridgedly attached flange 301 to which the rod 302 pivotally connects at the juncture 303. The other end of the rod 302 connects to a piston contained within the cylinder 306. The piston 306 in turn pivotally connects to the flanges 307 and 308 on the rear crossbar 291.

When the pressure within the cylinder 306 forces its piston to move outward, it extends the bar 302 to the right in FIGS. 19 and 20. This in turn causes the flange 301 to move downward. As a consequence, the scoop 278 moves around its rotating couplings 309 and 310 to the side bars 288 and 289. This causes the scoop 278 to move from the position shown in solid in FIGS. 18 and 19 to that shown by the dashed lines.

Conversely, when the pressure within the cylinder retracts the piston, the bar 302 moves to the left of FIGS. 19 and 20 and pulls the connection 303 with the flange 301 in that same direction. This in turn causes the flange 301 and the scoop 278 to rotate in the clockwise direction from the position shown in phantom FIG. 19 to that shown in solid lines. This moves the scoop from the releasing configuration to the holding configuration where it will retain ashes. This motion takes place, of course, with the scoop 278 in the pit 35 so that it may grab onto a portion of the ashes 272.

During the latter, or grabbing, type of motion, the scoop 278 may contact a solid object in the pit 35. This happens since the incinerator system 30 accepts bulk refuse without presorting. A common item that may find its way into the pit 35 is a muffler or other solid discard. Desirably, the cylinder 306 should not attempt to force the movement of the scoop 278 any further. Thus, in this intermediate configuration, the scoop 278 will remain in contact with the solid object.

As the trolley 273 then moves up the track 277, it will drag the solid object with it. At its top position, the scoop 278 will again move to its release position and drop the muffler or other solid item into the truck 37. The use of pneumatic controls for the cylinder 306 will provide it with this cushioning or flexibility to allow it to remove such solid objects without damage to itself or the track 277.

As further assistance, the controls may actually reduce the pressure within the cylinder 306 once the scoop 278 contacts the solid object within the pit 35. This provides additional assurance that the solid object will not damage any component of the ash removal system.

The fluid for controlling the cylinder 306 passes through the hoses 315 and 316 which in turn wrap around the reel 317. As the trolley 273 moves up and down the track 277, the reel 317 releases and recaptures the midportions 319 and 320 of the hoses to keep them out of the way of the trolley 273.

Again, with the trolley 273 in its lowest position where the scoop 278 enters the pit 35, the cylinder 306 and the reel 317 remain out of the water. They thus avoid the deleterious effects of the water, the ashes, and the chemicals contained in both of them. Furthermore, the winch operating the cable 284, as appears from FIG. 18, will always remain out of the water.

FIG. 22 shows the track mechanism generally at 325, but with a slightly different chute mechanism for delivering the ashes into the truck 37. The track 277 and the trolley 273 remain virtually the same as before.

However, the track 325 includes the rotating chute guide 326 which assumes the configuration shown in FIG. 22 with the trolley 273 near the top of the track. Then the scoop 278 moves from its retaining to its releasing configuration. When this occurs and the ashes drop from the scoop, the chute guide 326 directed the ashes to the truck 37. After the ashes have entered the truck 37, the chute guide 326 rotates in the counterclockwise direction shown in FIG. 22 so that its shovel 327 forms a portion of the trough 328.

The mechanism for controlling the rotating chute guide 326 appears more clearly in FIG. 23 which shows the opposite side of the track 325 from that seen in FIG. 22. As seen there, the operation of the rotating track portion 327 of the chute 326 results from the influence of the cylinder 330. When the cylinder 330 forces out its piston, the latter connects to the lever arm 331 rigidly attached to the rotating track portion 327. In that instance, the lever arm 331 will take the position shown in phantom and the track portion 327 will connect with the remaining of the chute 328.

When the piston 330 contracts, it pulls the lever arm 331 to the right to the position shown in FIG. 23 resulting in the track portion 327 rotating clockwise. This causes the debris from the scoop 278 to fall through to the truck 37.

An alternate type of scoop mechanism appearing generally at 337 in FIG. 24. It utilizes the same trolly as in FIGS. 19 and 20. Thus, it includes the same runner bars 288 and 289 with the crossbars 290 and 291. It moves along the track in the same manner as described previously utilizing the wheels 292 to 297.

This trolley employs, instead of the scoop 278 shown in the prior figures, the bucket 338 which has the holes 339 for water to pass through. The bucket 338 has a rotational coupling at the juncture 292 and the flange 340 which controls its configuration. The flange 340 in turn connects to the lever arm 341 which attaches to the usual bar 302. In turn, the bar 302 connects to a piston within the hydraulic cylinder 339. The cylinder 339, in turn, has a pivotal coupling to the flange 340 which must be added to the trolley 273 as of FIGS. 19 and 20.

To assure the proper movement of the bar 302 and the lever arm 341, the bar 302, at its juncture 303, also couples to the lever arm 346. The latter pivotally couples to the flange 347 attached by the braces 348 to the crossbar 290. The lever arm 346 thus assures the correct rotational motion of the juncture 303 and, concomitantly, the scooping movement of the bucket 338.

In operation, the extension of the rod 302 by the cylinder 344 will cause the bucket 338 to rotate in the clockwise direction in FIG. 24. In this configuration, it will not hold debris. The trolley 333 then descends into the water with the bucket 338 travelling between the track 277 and the trough 328.

When the bucket 338 reaches the bottom of the pit 35, the cylinder 344 retracts the bar 302. Under the influence of the lever arms 341 and 346, this causes the bucket 338 to rotate in the counterclockwise direction in FIG. 24. In effect, this induces the bucket, when in the pit, to move forward to scoop up ashes.

The trolley 337 then moves up the track 277. Then the cylinder extends the rod 302, and the bucket rotates in the clockwise direction of FIG. 24 and dumps its contents.

The use of the bucket 338 would appear warranted in situations producing heavy ash or debris such as gravel undergoing decontamination in the incinerator system. The stronger, hydraulic cylinder 344 would give the bucket 338 additional force to dig out the contents of the pit 35.

In comparison, the back hoe scoop 278 shown in FIGS. 19 and 20 would appear more desirable for the usual municipal waste. There the scoop 278 may have to stop its motion in the forward direction when contacting a solid object like a muffler or a bicycle. The pneumatic cylinder 306 has a greater cushioning to permit the scoop 278 to stop its motion when it makes the contact and yet not destroy either the cylinder 306 or the scoop 278. Furthermore, the valving for the cylinder 306 may reduce the pressure should the scoop 278 contact such a solid object. This helps avoid destruction in many of the components of the trolley 273 or the track 277.

Switching between the scoop 278 and the bucket 338 requires only minimal effort. Naturally, to carry the latter, the trolley should include the brackets 345 and 347. Otherwise, switching between the two mechanisms simply involves exchanging the cylinders 306 and 344 and the scoop 278 with the bucket 338. Additionally, the bucket 338 requires the lever arms 341 and 346 while the scoop 278 does not use any such lever arm. Thus, the ash removal system may employ either type of scoop depending upon the refuse placed into the incinerator.

Accordingly, what is claimed is:

1. In an incinerator system for bulk refuse and hydrocarbon-containing liquids having:

(1) a main combustion chamber with:

(a) a first inlet opening for the introduction of solid bulk refuse; and (b) a first outlet opening for the egress of the gaseous products of combustion from said main chamber; and (2) a reburn unit with:

(a) a second inlet opening, coupled to and in fluid communication with said first outlet opening;

(b) a second outlet opening for the egress of the gaseous products of combustion from said reburn unit;

(c) burner means, coupled to said reburn unit, for burning a fuel in said reburn unit; and (d) oxygenating means, coupled to said reburn unit, for introducing an oxygen-containing gas into said reburn unit, the improvement wherein:

(A) said reburn unit includes first and second separate reburn sections;

(B) said first outlet opening has first and second outlet ports each for permitting the egress of the gaseous products of combustion from said main combustion chamber;

(C) said second inlet opening has first and second inlet ports, coupled to and in fluid communication with, respectively, said first and second outlet ports, said first and second inlet ports opening into said first and second reburn sections, respectively;

(D) said second outlet opening includes third and fourth outlet ports from said first and second reburn sections, respectively;

(E) said burner means includes first and second burner sections, coupled to said first and second reburn sections, respectively, for burning a fuel in said first and second reburn sections, respectively, and (F) said oxygenating means includes first and second oxygenating sections, coupled to said first and second reburn sections, respectively, for introducing an oxygen-containing gas into said first and second reburn sections, respectively.

2. The improvement of claim 1 further including damper means, coupled between said second outlet port and said second inlet port, for selectively preventing the passage of a fluid from said second outlet port to said second inlet port.

3. The improvement of claim 2 wherein said first reburn section includes first and second stages and said second reburn section includes third and fourth stages with said first and third stages including said first and second inlet ports, respectively, and said third and fourth stages include said third and fourth outlet ports, respectively, and said first oxygenating section includes first and second oxygenating stages for introducing said oxygen containing gas into said first and second reburn stages, respectively, and said second oxygenating section includes third and fourth oxygenating stages for introducing oxygen into said third and fourth reburn stages, respectively, and further including first, second, third, and fourth sensing means for determining the temperatures in said first, second, third, and fourth reburn stages, respectively, and first, second, third, and fourth control means, coupled between said first second, third, and fourth sensing means and said first, second, third, and fourth oxygenating stages, respectively, for controlling the amount of said oxygen containing gas introduced into said first, second, third, and fourth reburn stages, respectively, in response to the temperatures determined by said first, second, third, and fourth sensing means.

4. The improvement of claim 3 wherein said damper means is a first damper means and further including second damper means, coupled between said first inlet port for selectively preventing the passage of a fluid from said first outlet port to said first inlet port.

5. The improvement of claim 4 wherein said main combustion chamber further includes heat removal means for absorbing a portion of the heat energy produced in said main chamber and transporting it to a location away from said main chamber.

6. The improvement of claim 2 further including choking means, coupled to said third outlet port for selectively reducing the cross-sectional area of said third outlet port.

7. The improvement of claim 6 wherein said oxygenating means is a first oxygenating means and further including (a) second oxygenating means for introducing an oxygen-containing gas into said main chamber and (b) reducing means, coupled to said second oxygenating means and to said damper means, for, when said damper means prevents the passage of a fluid from said second outlet port to said second inlet port, reducing the amount of said oxygen-containing gas introduced into said main chamber.

8. The improvement of claim 6 wherein said first reburn section includes first and second stages and said second reburn section includes third and fourth stages with said first and third stages including said first and second inlet ports, respectively, and said third and fourth stages include said third and fourth outlet ports, respectively, and said first oxygenating section includes first and second oxygenating stages for introducing said oxygen containing gas into said first and second reburn stages, respectively, and said second oxygenating section includes third and fourth oxygenating stages for introducing oxygen into said third and fourth reburn stages, respectively; and further including first, second, third, and fourth sensing means for determining the temperatures and said first, second, third, and fourth reburn stages, respectively, and first, second, third, and fourth control means, coupled between said first second, third, and fourth sensing means and said first, second, third, and fourth oxygenating stages, respectively, for controlling the amount of said oxygen containing gas introduced into said first, second, third, and fourth reburn stages, respectively, in response to the temperatures determined by said first, second, third, and fourth sensing means.

9. The improvement of claim 8 wherein said choking means is located at the end of said third reburn section.

10. The improvement of claim 6 further including (a) sensing means, coupled to said incinerator system, for determining a condition within said incinerator system and (b) choking control means, coupled to said sensing means and to said choking means, for, in response to the condition determined by said sensing means, controlling the amount of cross-sectional area of said third outlet port closed off by said choking means.

11. The improvement of claim 10 wherein said sensing means is a temperature sensing means coupled to said first and second reburn sections for determining a temperature in said first and second reburn sections, respectively, and choking control means, coupled to said first and second reburn sections and to said choking means, for, when the temperature sensed by said temperature sensing means falls below a predetermined level, causing said choking means to reduce the cross-sectional area of said third and outlet port.

12. The improvement of claim 10 further including steam producing means, coupled to said incinerator system, for utilizing the heat of said system to convert water to steam, and wherein said sensing means is a pressure sensing means coupled to said steam producing means for determining the pressure of steam produced by said steam producing means, and said choking control means couples to said steam sensing means and to said choking means for, when the steam pressure determined by said steam sensing means falls below a predetermined level, reducing the cross-sectional areas of said third and outlet openings respectively.

13. The improvement of claim 10 wherein said choking means reduces the size of said third outlet port by blocking off one side of said third outlet port respectively.

14. The improvement of claim 10 wherein said choking means is a butterfly choke damper.

15. The improvement of claim 10 wherein said choking means can reduce the cross-sectional area of said third outlet port up to 60 percent of the area of said third outlet port.

16. The improvement of claim 10 wherein said choking means is a first choking means and further including second choking means, coupled to said fourth outlet port, for selectively reducing the cross-sectional area of said fourth outlet port.

17. The improvement of claim 16 wherein said choking control means is a first choking control means and further including second choking control means, coupled to said sensing means and to said second choking means, for, in response to a condition determined by said sensing means, causing said second choking means to reduce the cross-sectional area of said fourth outlet port.

18. The improvement of claim 2 further including first and second excitor means placed within, surrounded by, and coupled to said first and second reburn sections, respectively, the majority of the length of said first and second excitor means, in passing from said first and second inlet ports to said third and fourth outlet ports, respectively, being out of contact with the wall of said first and second reburn sections, for reducing the cross-sectional areas of said first and reburn sections on a plain transverse to the paths passing from said first and second inlet ports to said third and fourth outlet ports, respectively.

19. The improvement of claim 18 further including nozzles arranged on said first and second excitor means and in fluid communication with said first and second oxygenating sections respectively, and wherein said first and second oxygenating sections couple to said first and second excitor means, respectively, and introduces said oxygenating-containing gas into said first and reburn sections through said nozzles.

20. The improvement of claim 19 wherein said first and second oxygenating sections include first and second plenums located on the exterior of said first and second reburn sections, respectively, and said first and second oxygenating sections passes said oxygen-containing gas through said first and second plenums prior to passing it into said first and second reburn sections through said nozzles on said first and second excitor means, respectively.

21. The improvement of claim 19 wherein at least a portion of said nozzles on said first and second excitor means introduce said oxygen-containing gas at a non perpendicular angle relative to said paths from said first and second inlet ports to said third and fourth outlet ports, respectively.

22. The improvement of claim 21 further including nozzles located on the walls of said first and second reburn sections in fluid communication with said first and second oxygenating sections and wherein said first and second oxygenating sections introduce said oxygen-containing gas into said first and second reburn sections through said nozzles located on said first and second excitor means and through said nozzles located on said walls of said first and second reburn sections.

23. The improvement of claim 22 wherein at least a portion of said nozzles on said first and second excitor means introduce said oxygen-containing gas with both a tangential and a radial component of velocity relative to said paths from said first and second inlet ports to said third and fourth outlet ports, respectively.

24. The improvement of claim 19 wherein said first and second oxygenating sections introduce said oxygen-containing gas only through said nozzles on said excitor means.

25. The improvement of claim 18 wherein the respective distances between said first and second excitor means and the walls of said first and second reburn sections, respectively, at particular locations along the length of said first and second excitor means, or substantially equidistant around said first and second excitor means, respectively.

26. The improvement of claim 25 wherein the space between said first and second excitor means and said first and second reburn sections, respectively, are substantially annular.

27. The improvement of claim 25 wherein the spaces between said first and second excitor means and said first and second reburn sections near said first and second inlet ports are less than near said third and fourth outlet ports, respectively.

28. The improvement of claim 6 further including first and second excitor means placed within, surrounded by, and coupled to said first and second reburn sections, respectively, the majority of the length of said first and second excitor means, in passing from said first and second inlet ports to said third and fourth outlet ports, respectively, being out of contact with the walls of said first and second reburn sections, for reducing the cross-sectional areas of said first and reburn sections on plains transverse to the paths passing from said first and second inlet ports to said third and fourth outlet ports, respectively.

29. The improvement of claim 28 further including (a) sensing means, coupled to said incinerator system, for determining a condition within said incinerator system and (b) choking control means, coupled to said sensing means and to said choking means for, in response to the condition determined by said sensing means, controlling the amount of cross-sectional area of said third outlet port closed off by said choking means.

30. The improvement of claim 29 wherein said choking control means is a first choking control means and further including second choking control means, coupled to said sensing means and to said second choking means, for, in response to a condition determined by said sensing means, causing said second choking means to reduce the cross-sectional area of said fourth outlet port.

31. The improvement of claim 30 further including nozzles arranged on said first and second excitor means and in fluid communication with said first and second oxygenating sections respectively, and wherein said first and second oxygenating sections couple to said first and second excitor means, respectively, and introduces said oxygenating-containing gas into said first and reburn sections through said nozzles.

32. The improvement of claim 31 wherein at least a portion of said nozzles on said first and second excitor means introduce said oxygen-containing gas at a nonperpendicular angle relative to said paths from said first and second inlet ports to said third and fourth outlet ports, respectively.

33. The improvement of claim 32 wherein at least a portion of said nozzles on said first and second excitor means introduce said oxygen-containing gas with both a tangential and a radial component of velocity relative to said paths from said first and second inlet ports to said third and fourth outlet ports, respectively.

34. The improvement of claim 33 wherein the space between said first and second excitor means and said first and second reburn sections near said first and second inlet ports is less than near said third and fourth outlet ports, respectively.

35. The improvement of claim 34 wherein further including control means, coupled to said and first and second damper means, for causing said first and second damper means to substantially close said first and second outlet ports, respectively.

36. In an incinerator system for bulk refuse and hydrocarbon-containing liquids having:

(1) a main combustion chamber with:

(a) a first inlet opening for the introduction of solid bulk refuse; and (b) a first outlet opening for the egress of the gaseous products of combustion from said main chamber; and (2) a reburn unit with:

(a) a second inlet opening, coupled to and in fluid communication with said first outlet opening;

(b) a second outlet opening for the egress of the gaseous products of combustion from said reburn unit;

(c) burner means, coupled to said reburn unit, for burning a fuel in said reburn unit; and (d) oxygenating means, coupled to said reburn unit, for introducing an oxygen-containing gas into said reburn unit, the improvement comprising (A) excitor means placed within, surrounded by, and coupled to said reburn unit, the majority of the length of said excitor means, in passing from said second inlet opening to said second outlet opening, being out of contact with the wall of said reburn unit, for reducing the cross-sectional area of said reburn unit on a plane transverse to the path passing from said second inlet opening to said second outlet opening and (B) a plurality of nozzle means, coupled to, in fluid communications with, and forming part of said oxygenating means, said nozzle means being connected to and arranged on the surface of said excitor means and being for introducing said oxygen-containing gas into the space between the inner surface of said reburn unit and said excitor means at a nonperpendicular angle to said path and with a component of motion in the direction from said second inlet opening to said second outlet opening.

37. The improvement of claim 36 further including cooling means, coupled to said excitor means, for reducing the temperature of said excitor means.

38. The improvement of claim 37 wherein said cooling means includes a plenum located within said excitor means and wherein said oxygenating means couples to said excitor means and introduces said oxygenating-containing gas into said reburn unit through nozzles arranged on said excitor means.

39. The improvement of claim 38 wherein said plenum is a first plenum, said oxygenating means includes a second plenum located on the exterior of said reburn unit, and said oxygenating means passes said oxygen-containing gas through said second plenum and then to said first plenum and then through said nozzles on said excitor means.

40. The improvement of claim 39 further including nozzles located on the wall of said reburn unit in fluid communication with said oxygenating means and wherein said oxygenating means introduces said oxygen-containing gas into said reburn unit through said nozzles located on said excitor means and through nozzles located on the wall of said reburn unit.

41. The improvement of claim 39 wherein said oxygenating means introduces said oxygen-containing gas only through said nozzles on said excitor means.

42. The improvement of claim 41 wherein at least a portion of said nozzles on said excitor means introduce an oxygen-containing gas with both a tangential and a radial component of velocity relative to said path from said second inlet opening to said outlet opening.

43. The improvement of claim 42 wherein said nozzles of said portion introduce an oxygen-containing gas at an angel of about 45 degrees relative to said path of said gasses.

44. The improvement of claim 43 wherein said nozzles of said portion introduce an oxygen-containing gas into said reburn section at an angle not greater than about 45 degrees relative to radial lines drawn from the center of said excitor means directly to the wall of said reburn unit.

45. The improvement of claim 42 wherein the space between said excitor means and the wall of said reburn unit near said inlet opening is less than near said outlet opening.

46. The improvement of claim 45 wherein the fluid within said reburn unit has a component of velocity in direction of said path from said second inlet opening to said second outlet opening of not greater than about 55 feet per second.

47. The improvement of claim 46 wherein said nozzles on said excitor means are arranged in rows relative to said path from said second inlet opening to said second outlet opening, with the nozzles of a particular one of said rows having a staggard configuration relative to the nozzles on the preceeding row and to the nozzles on the succeeding row.

48. The improvement of claim 47 wherein said component of velocity is not greater than about 46 feet per second.

49. The improvement of claim 46 wherein said space between said excitor means and said wall of said reburn unit has at least one sharp increase along said path.

50. The improvement of claim 46 wherein said space between said excitor means and said wall of said reburn unit increases gradually along at least a portion of said path from said second inlet opening to said second outlet opening.

51. The improvement of claim 38 including (a) a first support connected between said excitor means near said second inlet opening and said wall of said reburn unit and (b) a second support connected between said excitor means near said second outlet opening and said wall of said reburn unit, said first and second supports holding said excitor means within said reburn unit and having hollow interior in fluid communication with said plenum in said excitor means and a substantially rectangular cross-section on planes parallel to said path from said second inlet opening to said second outlet opening, and wherein said oxygenating means introduces said oxygen-containing gas to said plenum in said excitor means through said first and second supports.

52. The improvement of claim 46 wherein the distance between said excitor means and the wall of said reburn unit at a particular location along the length of said excitor means is substantially equidistant around said excitor means.

53. The improvement of claim 52 wherein the space between said excitor means and said reburn unit, is substantially annular.

54. The improvement of claim 38 wherein the surface of said excitor means facing said interior of said reburn unit is composed of a material having a thermal conductivity constant k less than about $$\frac{60 \text{ Btu. in.}}{\text{hr. ft.2 °F.}}$$

where k is defined by $$k = \frac{gl}{AT}$$

where q is the heat conductivity in Btu/hr. through a surface of thickness 1 in inches, area A in square feet, and temperature T in F.

55. The improvement of claim 54 wherein at least a portion of said nozzles on said excitor means introduce an oxygen-containing gas with both a tangential and a radial component of velocity relative to said path from said second inlet opening to said second outlet opening.

56. The improvement of claim 55 wherein the surface of said excitor means facing said interior is composed of a heat and corrosion resistant material and wherein k is not greater than about 24.

57. In an incinerator system for bulk refuse and hydrocarbon-containing liquids having:

(1) a main combustion chamber with:
- (a) a first inlet opening for the introduction of solid bulk refuse; and
- (b) a first outlet opening for the egress of the gaseous products of combustion from said main chamber; and (2) a reburn unit with:
- (a) a second inlet opening, coupled to and in fluid communication with said first outlet opening;
- (b) a second outlet opening for the egress of the gaseous products of combustion from said reburn unit;
- (c) burner means, coupled to said reburn unit, for burning a fuel in said reburn unit; and
- (d) oxygenating means, coupled to said reburn unit, for introducing an oxygen-containing gas into said reburn unit, the improvement comprising choking means, coupled to said second outlet opening, for selectively reducing the cross-sectional area of said second outlet opening.

58. The improvement of claim 57 wherein said oxygenating means is a first oxygenating means and further including second oxygenating means for introducing an oxygen-containing gas into said main chamber and reducing means, coupled to said second oxygenating means and to said choking means for, when said choking means reduces the cross-sectional area of said second outlet opening, reducing the amount of said oxygen-containing gas introduced into said main chamber.

59. The improvement of claim 58 wherein said reburn unit includes first and second stages with said first stage including said second inlet opening, and said second stage including said second outlet opening, and said oxygenating means includes first and second oxygenating stages for introducing said oxygen containing gas into said first and second reburn stages, respectively and further including first and second sensing means for determining the temperatures in said first and second reburn stages, respectively, and first and second control means, coupled between said first and second sensing means and said first and second oxygenating stages for controlling the amount of said oxygen containing gas introduced into said first and second reburn stages, respectively, in response to the temperatures determined by said first and second sensing means.

60. The improvement of claim 59 wherein said choking means is located at the end of said second reburn stage.

61. The improvement of claim 57 further including (a) sensing means, coupled to said incinerator system, for determining a condition within said incinerator system and (b) choking control means, coupled to said sensing means and to said choking means for, in response to the condition determined by said sensing means, controlling the amount of the cross-sectional area of said second outlet opening closed reduced by said choking means.

62. The improvement of claim 61 wherein said temperature sensing means is a temperature sensing means, coupled to said reburn unit, and said choking control means, when the temperature sensed by said temperature sensing means falls below a predetermined level, causes said choking means to reduce the cross-sectional areas of said second outlet opening.

63. The improvement of claim 61 further including steam producing means coupled to said incinerator system for utilizing the heat of said system to convert water to steam, and wherein said sensing means is a pressure sensing means, coupled to said steam producing means, for determining the pressure of steam produced by said steam producing means, and said choking control means, when the steam pressure determined by said steam sensing means falls below a predetermined level, causes said choking means to reduce the cross-sectional area of said outlet opening.

64. The improvement of claim 61 wherein said choking means reduces the size of said second outlet opening by blocking off one side of said second outlet opening.

65. The improvement of claim 61 wherein said choking means is a butterfly choke damper.

66. The improvement of claim 61 further including (A) excitor means placed within, surrounded by, and coupled to said reburn unit, the majority of the length of said excitor means, in passing from said second inlet opening to said second outlet opening, being out of contact with the wall of said reburn unit, for reducing the cross-sectional area of said reburn unit on a plane transverse to the path passing from said second inlet opening to said second outlet opening and (B) a plurality of nozzle means, coupled to, in fluid communications with, and forming part of said oxygenating means, said nozzle means being connected to and arranged on the surface of said excitor means and being for introducing said oxygen-containing gas into the space between the inner surface of said reburn unit and said excitor means at a nonperpendicular angle to said path.

67. The improvement of claim 66 wherein at least a portion of said nozzles on said excitor means introduce said oxygen-containing gas with both a tangential and a radial component of velocity relative to said path from said second inlet opening to said second outlet opening.

68. The improvement of claim 67 further including nozzles located on the wall of said reburn unit in fluid communication with said oxygenating means and wherein said oxygenating means introduces said oxygen-containing gas into said reburn unit through said nozzles located on said excitor means and through said nozzles located on the walls of said reburn unit.

69. The improvement of claim 67 wherein said oxygenating means introduces said oxygen-containing gas only through said nozzles on said excitor means.

70. The improvement of claim 67 wherein the distance between said excitor means and the wall of said reburn unit at a particular location along the length of said excitor means is substantially equidistant around said excitor means.

71. The improvement of claim 70 wherein the space between said excitor means and said reburn unit is substantially annular.

72. The improvement of claim 70 wherein said excitor means includes a plenum in fluid communication with said oxygenating means and nozzles on the surface of said excitor means in fluid receive plenum in fluid communication with said plenum and oxygenating means and introduces said oxygenating-containing gas into said reburn unit through said nozzles.

73. The improvement of claim 72 wherein said plenum is a first plenum said oxygenating means including a second plenum located on the exterior of said reburn unit and said oxygenating means passes said oxygen-containing gas through said second plenum prior to passing it into said reburn unit through said nozzles on said excitor means.

74. The improvement of claim 72 wherein the space between said excitor means and the wall of said reburn unit near said second inlet opening is less than near said second outlet opening.

75. The improvement of claim 74 wherein said space between said excitor means and said wall of said reburn unit has at least one sharp increase along said path.

76. The improvement of claim 74 wherein said space between said excitor means and said wall of said reburn unit increases gradually along at least a portion of said path from said second inlet opening to said second outlet opening.

77. The improvement of claim 72 including (a) a first support connected between said excitor means near said second inlet opening and said wall of said reburn unit and (b) a second support connected between said excitor means near said second outlet opening and said wall of said reburn unit, said first and second supports holding said excitor means within said reburn unit and having hollow interiors in fluid communication with said plenum in said excitor means substantially rectangular cross-section on planes parallel to said path from said second inlet opening to said second outlet opening, and wherein said oxygenating means introduces said oxygen-containing gas to said plenum in said excitor means through said first and second supports.

78. The improvement of claim 67 wherein the surface of said excitor means facing said interior is composed of a heat and corrosion resistant material.

79. The improvement of claim 78 wherein the surface of said excitor means facing said interior of said reburn unit is composed of a material having a thermal conductivity constant k less than about $$\frac{60 \text{ Btu. in.}}{\text{hr. ft.2 °F.}}$$

where k is defined by $$k = \frac{gl}{AT}$$

where q is the heat conductivity in Btu/hr. through a surface of thickness in inches, area A in square feet, and temperature T in ° F.

80. The improvement of claim 79 wherein the fluid within said reburn unit has a component of velocity in the direction of said path from said outlet opening to said second outlet opening of not greater than about 46 feet per second.

81. The improvement of claim 67 wherein the surface of said excitor means facing said interior of said reburn unit is composed of a material having a thermal conductivity constant k less than about $$\frac{60 \text{ Btu. in.}}{\text{hr. ft.2 °F.}}$$

where k is defined by $$k = \frac{gl}{AT}$$

where q is the heat conductivity in Btu/hr. through a surface of thickness 1 in inches, area A in square feet, and temperature T in °F.

82. The improvement of claim 81 wherein the fluid within said reburn unit has a component of velocity in the directions of said path from said outlet opening to said second outlet opening of not greater than about 46 feet per second.

83. The improvement of claim 66 wherein said choking means can reduce the cross-sectional area of said second outlet openings up to 60 percent of the area of said second outlet opening.

84. The improvement of claim 61 wherein said second choking can reduce the cross-sectional area of said second outlet opening up to 60 percent of the area of said second outlet opening.

85. In an incinerator system for bulk refuse and hydrocarbon-containing liquids having:

(1) a main combustion chamber with:
- (a) a first inlet opening for the introduction of solid bulk refuse; and
- (b) a first outlet opening for the egress of the gaseous products of combustion from said main chamber; and (2) a reburn unit with:
- (a) a second inlet opening, coupled to and in fluid communication with said first outlet opening;
- (b) a second outlet opening for the egress of the gaseous products of combustion from said reburn unit;
- (c) burner means, coupled to said reburn unit, for burning a fuel in said reburn unit; and
- (d) oxygenating means, coupled to said reburn unit, for introducing an oxygen-containing gas into said reburn unit, the improvement (a) comprising excitor means, coupled to, placed within, and surrounded by said reburn unit, the majority of the length of said excitor means, in passing from said second inlet opening to said second outlet opening, being out of contact with the wall of said reburn unit, for reducing the cross-sectional area of the interior of said reburn unit on a plane transverse to the path passing from said second inlet opening to said second outlet opening, the surface of said excitor means facing said interior being composed of a heat and corrosion resistant material, (b) nozzles arranged on said excitor means, said oxygenating means coupling to said oxygenating means and introducing said oxygen-containing gas into said reburn unit through said nozzles, (c) a first support connected between said excitor means near said second inlet opening and said wall of said reburn unit, and (d) a second support connected between said excitor means near said second outlet opening and said wall of said reburn unit, said first and second supports holding said excitor means within said reburn unit and having hollow interiors in fluid communication with said plenum in said excitor means and a substantially rectangular cross-section on planes parallel to said path from said second inlet opening to said second outlet opening, and wherein said oxygenating means introduces said oxygen-containing gas to said excitor means through said first and second supports.

86. The improvement of claim 85 further including cooling means, coupled to excitor means, for reducing the temperature of said excitor means.

87. The improvement of claim 86 wherein said oxygenating means includes a plenum located on the exterior of said reburn unit and said oxygenating means passes said oxygen-containing gas through said plenum prior to passing it into said reburn unit through said nozzles on said excitor means.

88. The improvement of claim 87 wherein said nozzles on said excitor means are arranged in rows relative to said path from said second inlet opening to said second outlet opening with the nozzles of a particular one of said rows having a staggard configuration relative to the nozzles on the preceeding row and to the nozzles on the succeeding row.

89. The improvement of claim 87 wherein the distance between said excitor means and the wall of said reburn unit at a particular location along the length of said excitor means is substantially equidistant around said excitor means.

90. The improvement of claim 89 wherein said space between said excitor means and said wall of said reburn unit has at least one sharp increase along said path.

91. The improvement of claim 89 wherein said space between said excitor means and said wall of said reburn unit increases gradually along at least a portion of said path from said second inlet opening to said second outlet opening.

92. The improvement of claim 87 wherein the surface of said excitor means facing said interior of said reburn unit is composed of a material having a thermal conductivity constant k less than about $$\frac{60 \text{ Btu. in.}}{\text{hr. ft.2 °F.}}$$

where k is defined by $$k = \frac{gl}{AT}$$

where q is the heat conductivity in Btu/hr. through a surface of thickness 1 in inches, area A in square feet, and temperature T in °F.

93. The improvement of claim 92 wherein k is not greater than about 24.

94. In an incinerator system for bulk refuse and hydrocarbon-containing liquids having:

(1) a main combustion chamber with:
- (a) a first inlet opening for the introduction of solid bulk refuse; and
- (b) a first outlet opening for the egress of the gaseous products of combustion from said main chamber; and (2) a reburn unit with:
- (a) a second inlet opening, coupled to and in fluid communication with said first outlet opening;
- (b) a second outlet opening for the egress of the gaseous products of combustion from said reburn unit;
- (c) burner means, coupled to said reburn unit, for burning a fuel in said reburn unit; and
- (d) oxygenating means, coupled to said reburn unit, for introducing an oxygen-containing gas into said reburn unit, the improvement comprising excitor means, coupled to, placed within, and surrounded by said reburn unit, the majority of the length of said excitor means, in passing from said second inlet opening to said second outlet opening, being out of contact with the wall of said reburn unit, for reducing the cross-sectional area of the interior of said reburn unit on a plane transverse to the path passing from said second inlet opening to said second outlet opening, the surface of said excitor means facing said interior being composed of a material having a thermal conductivity constant k less than about $$\frac{60 \text{ Btu. in.}}{\text{hr. ft.2 °F.}}$$

where k is defined by $$k = \frac{gl}{AT}$$

where q is the heat conductivity in Btu/hr. through a surface of thickness 1 in inches, area A in square feet, and temperature T in °F.

95. The improvement of claim 94 further including cooling means, coupled to said excitor means, for reducing the temperature of said excitor means.

96. The improvement of claim 95 further including nozzles arranged on said excitor means and in fluid communication with said oxygenating means coupled to nozzles and introducing said oxygenating-containing gas into said reburn unit through said nozzles.

97. The improvement of claim 96 wherein said oxygenating means includes a plenum located on the exterior of said reburn unit and said oxygenating means passes said oxygen-containing gas through said plenum prior to passing it into said reburn unit through said nozzles on said excitor means.

98. The improvement of claim 97 wherein said nozzles on said excitor means are arranged in rows in said path from said second inlet opening to said second outlet opening with the nozzles of a particular one of set rows having a staggard configuration relative to the nozzles on the preceeding row and to the nozzles on the succeeding row.

99. The improvement of claim 97 including (a) a first support connected between said excitor means near said second inlet opening and said wall of said reburn unit and (b) a second support connected between said excitor means near said second outlet opening and said wall of said reburn unit, said first and second supports holding said excitor means within said reburn unit and having hollow interiors in fluid communication with said plenum in said excitor means and a substantially rectangular cross-section on planes parallel to said path from said second inlet opening to said second outlet opening, and wherein said oxygenating means introduces said oxygen-containing gas to said plenum in said excitor means through said first and second supports.

100. The improvement of claim 97 wherein the distance between said excitor means and the wall of said reburn unit at a particular location along the length of said excitor means is substantially equidistant around said excitor means.

101. The improvement of claim 100 wherein said space between said excitor means and said wall of said reburn unit has at least one sharp increase along said path.

102. The improvement of claim 100 wherein said space between said excitor means and said wall of said reburn unit increases gradually along at least a portion of said path from said second inlet opening to said second outlet opening.

103. The improvement of claim 97 wherein k is not greater than about 24.

104. In a fume burning system for improving the environmental quality of a gaseous fluid emanating from the output of a source and containing combustible hydrocarbons comprising a reburn unit with:

(1) an inlet opening, coupled to and in fluid communication with said output;

(2) an outlet opening for the egress of the gaseous products of combustion from said reburn unit;

(3) burner means, coupled to said reburn unit, for burning a fuel in said reburn unit; and (4) oxygenating means, coupled to said reburn unit, for introducing an oxygen-containing gas into said reburn unit, the improvement wherein:

(A) said reburn unit includes first and second separate reburn sections;

(B) said inlet opening has first and second inlet ports, coupled to and in fluid communication with said output, said first and second inlet ports opening into said first and second reburn sections, respectively;

(C) said outlet opening includes first and second outlet ports from said first and second reburn sections, respectively;

(D) said burner means includes first and second burner sections, coupled to said first and second reburn sections, respectively, for burning a fuel in said first and second reburn sections, respectively; and (E) said oxygenating means includes first and second oxygenating sections, coupled to said first and second reburn sections, respectively, for introducing an oxygen-containing gas into said first and second reburn sections, respectively.

105. The improvement of claim 104 further including damper means, coupled between said output and said second inlet port, for selectively preventing the passage of a fluid from said output to said second inlet port.

106. The improvement of claim 105 wherein said first reburn section includes first and second stages and said second reburn section includes third and fourth stages with said first and third stages including said first and second inlet ports, respectively, and said third and fourth stages including said first and second outlet ports, respectively, and said first oxygenating section includes first and second oxygenating stages for introducing said oxygen containing gas into said first and second reburn stages, respectively, and said second oxygenating section including third and fourth oxygenating stages for introducing oxygen into said third and fourth reburn stages, respectively and further including first, second, third, and fourth sensing means for determining the temperatures and said first, second, third, and fourth reburn stages, respectively, and first, second, third and fourth control means, coupled between said first, second, third, and fourth sensing means and said first, second, third, and fourth oxygenating stages, respectively, for controlling the amount of said oxygen containing gas introduced into said first, second, third, and fourth reburn stages, respectively, in response to the temperatures determined by said first, second, third, and fourth sensing means.

107. The improvement of claim 106 wherein said damper means and further including second damper means, coupled between said output and first inlet port for selectively preventing the passage of a fluid from said output to said second inlet port.

108. The improvement of claim 105 further including choking means, coupled to said first outlet port, for selectively reducing the cross-sectional area of said first outlet port.

109. The improvement of claim 108 wherein said first reburn section includes first and second stages and said second reburn section includes third and fourth stages with said first and third stages including said first and second inlet ports, respectively, and said third and fourth stages include said first and second outlet ports, respectively, and said first oxygenating section includes first and second oxygenating stages for introducing said oxygen containing gas into said first and second reburn stages, respectively, and said second oxygenating section includes third and fourth oxygenating stages for introducing oxygen into said third and fourth reburn stages, respectively, and further including first, second, third, and fourth sensing means for determining the temperatures and said first, second, third, and fourth reburn stages, respectively, and first, second, third, and fourth control means, coupled between said first second, third, and fourth sensing means and said first, second, third, and fourth oxygenating stages for controlling the amount of said oxygen containing gas introduced into said first, second, third, and fourth reburn stages, respectively, in response to the temperatures determined by said first, second, third, and fourth sensing means.

110. The improvement of claim 109 wherein said choking means is located at the end of said third reburn section.

111. The improvement of claim 108 further including (a) sensing means, coupled to said system, for determining a condition within said system and (b) choking control means, coupled to said sensing means and to said choking means for, in response to the condition determined by said sensing means, controlling the amount of cross-sectional area of said first outlet port closed off by said choking means.

112. The improvement of claim 111 wherein said sensing means is a temperature sensing means coupled to said first and second reburn sections, for determining a temperature in said first and second reburn sections, respectively, and choking control means, coupled to said first and second reburn sections into said first and second choking means, for, when the temperature sensed by said temperature sensing means falls below a predetermined level, causing said choking means to reduce the cross-sectional areas of said first outlet port.

113. The improvement of claim 111 further including steam producing means, coupled to said system, for utilizing the heat of said system to convert water to steam, wherein said sensory means is a pressure sensing means coupled to said steam producing means for determining the pressure of steam produced by said steam producing means, and said choking control means couples to said steam sensing means, and to said first and second choking means for, when the steam pressure determined by said steam sensing means falls below a predetermined level, reducing the cross-sectional areas of said second and first outlet openings respectively.

114. The improvement of claim 111 wherein said choking means reduces the size of said first outlet port by blocking off one side of said first outlet port.

115. The improvement of claim 111 wherein said choking means is a butterfly choke damper.

116. The improvement of claim 111 wherein said choking means can reduce the cross-sectional area of said second second and first outlet port up to 60 percent of the area of said first outlet port.

117. The improvement of claim 111 wherein said choking means is a first choking means and further including second choking means, coupled to said second outlet port, for selectively reducing the cross-sectional area of said second outlet port.

118. The improvement of claim 117 wherein said choking control means is a first choking control means and further including second choking control means, coupled to said sensing means and to said second choking means, for, in response to a condition determined by said sensing means, causing said second choking means to reduce the cross-sectional area of said second outlet port.

119. The improvement of claim 105 further including first and second excitor means placed within, surrounded by, and coupled to said first and second reburn sections, respectively, the majority of the length of said first and second excitor means, in passing from said first and second inlet ports to said first and second outlet ports, respectively, being out of contact with the wall of said first and second reburn sections, for reducing the cross-sectional areas of said first and reburn sections on planes transverse to the paths passing from said first and second inlet ports to said first and second outlet ports, respectively.

120. The improvement of claim 119 further including nozzles arranged on said first and second excitor means and in fluid communication with said first and second oxygenating sections respectively and wherein said first and second oxygenating sections couples to said first and second excitor means, respectively, and introduces said oxygenating-containing gas into said first and reburn sections through said nozzles arranged on said first and second excitor means, respectively.

121. The improvement of claim 120 wherein said first and second oxygenating sections include first and second plenums located on the exterior of said first and second reburn sections, respectively, and said oxygenating means passes said oxygen-containing gas through said first and second plenums prior to passing it into said first and second reburn sections through said nozzles on said first and second excitor means, respectively.

122. The improvement of claim 120 wherein at least a portion of said nozzles on said first and second excitor means introduce said oxygen-containing gas at a non-perpendicular angle relative to said paths from said first and second inlet ports to said first and second outlet ports, respectively.

123. The improvement of claim 122 further including nozzles located on the walls of said first and second reburn sections in fluid communication with said first and second oxygenating sections and wherein said first and second oxygenating sections introduce said oxygen-containing gas into said first and second reburn sections through said nozzles located on said first and second excitor means and through said nozzles located on the walls of said first and second reburn sections.

124. The improvement of claim 123 wherein at least a portion of said nozzles on said first and second excitor means introduce said oxygen-containing gas with both a tangential and a radial component of velocity relative to said paths from said first and second inlet ports to said first and second outlet ports, respectively.

125. The improvement of claim 119 wherein said first and second oxygenating sections introduces said oxygen-containing gas only through said nozzles on said excitor means.

126. The improvement of claim 119 wherein the respective distances between said first and second excitor means and the walls of said first and second reburn sections, respectively, at particular locations along the length of said first and second excitor means, are substantially equidistant around said first and second excitor means, respectively.

127. The improvement of claim 126 wherein the space between said first and second excitor means and said first and second reburn sections, respectively, are substantially annular.

128. The improvement of claim 126 wherein the spaces between said first and second excitor means and said first and second reburn sections near said first and second inlet ports are less than near said first and second outlet ports, respectively.

129. The improvement of claim 108 further including first and second excitor means placed within, surrounded by, and coupled to said first and second reburn sections, respectively, the majority of the length of said first and second excitor means, in passing from said first and second inlet ports to said first and second outlet ports, respectively, being out of contact with the walls of said first and second reburn sections, for reducing the cross-sectional areas of said first and reburn sections on plains transverse to the paths passing from said first and second inlet ports to said first and second outlet ports, respectively.

130. The improvement of claim 129 further including (a) sensing means, coupled to said system for determining a condition within said system, and (b) choking control means, coupled to said sensing means and to said choking means for, in response to the condition determined by said sensing means, controlling the amount of cross-sectional area of said first outlet port closed off by said choking means.

131. The improvement of claim 119 wherein said choking control means is a first choking control means and further including second choking control means, coupled to said sensing means and to said second choking means, for, in response to a condition determined by said sensing means, causing said second choking means to reduce the cross-sectional area of said second outlet port.

132. The improvement of claim 131 further including nozzles arranged on said first and second excitor means and in fluid communication with said first and second oxygenating sections respectively and wherein said first and second oxygenating sections couples to said first and second excitor means, respectively, and introduces said oxygenating-containing gas into said first and reburn sections through said nozzles arranged on said first and second excitor means, respectively.

133. The improvement of claim 132 wherein at least a portion of said nozzles on said first and second excitor means introduce said oxygen-containing gas at a nonperpendicular angle relative to said paths from said first and second inlet ports to said first and second outlet ports, respectively.

134. The improvement of claim 133 wherein at least a portion of said nozzles on said first and second excitor means introduce said oxygen-containing gas with both a tangential and a radial component of velocity relative to said paths from said first and second inlet ports to said first and second outlet ports, respectively.

135. The improvement of claim 134 wherein the spaces between said first and second excitor means and said first and second reburn sections near said first and second inlet ports is less than near said first and second outlet ports, respectively.

136. The improvement of claim 135 further including control means, coupled to said and first and second damper means for causing said first and second damper means to substantially close said first and second inlet ports, respectively.

137. In a fume burning system for improving the environmental quality of a gaseous fluid emanating from the output of a source and containing combustible hydrocarbons comprising a reburn unit with:

(1) an inlet opening, coupled to and in fluid communication with said output;
(2) an outlet opening for the egress of the gaseous products of combustion from said reburn unit;
(3) burner means, coupled to said reburn unit, for burning a fuel in said reburn unit; and
(4) oxygenating means, coupled to said reburn unit, for introducing an oxygen-containing gas into said reburn unit, the improvement comprising:

(A) excitor means, placed within, surrounded by, and coupled to said reburn unit, the majority of the length of said excitor means, in passing from said inlet opening to said outlet opening, being out of contact with the wall of said reburn unit, for reducing the cross-sectional area of said reburn unit on a plane transverse to the path passing from said inlet opening to said outlet opening; and
(B) a plurality of nozzle means, coupled to, in fluid communications with, and forming part of said oxygenating means, said nozzle means being connected to and arranged on the surface of said excitor means and being for introducing said oxygen-containing gas into the space between the inner surface of said reburn unit and said excitor means at a nonperpendicular angle to said path and with a component of motion in the direction from said inlet opening to said outlet opening.

138. The improvement of claim 137 further including cooling means, coupled to said excitor means, for reducing the temperature of said excitor means.

139. The improvement of claim 138 wherein said cooling means includes a plenum located within said excitor means and wherein said oxygenating means couples to said excitor means and introduces said oxygenating-containing gas into said reburn unit through nozzles arranged on said excitor means.

140. The improvement of claim 139 wherein said plenum is a first plenum, said oxygenating means includes a second plenum located on the exterior of said reburn unit, and said oxygenating means passes said oxygen-containing gas through said second plenum and then to said first plenum and then through said nozzles on said excitor means.

141. The improvement of claim 140 further including nozzles located on the wall of said reburn unit in fluid communication with said oxygenating means and wherein said oxygenating means introduces said oxygen-containing gas into said reburn unit through said nozzles sections located on said excitor means and through nozzles located on the wall of said reburn unit.

142. The improvement of claim 140 wherein said oxygenating means introduces said oxygen-containing gas only through said nozzles on said excitor means.

143. The improvement of claim 142 wherein at least a portion of said nozzles on said excitor means introduce an oxygen-containing gas with both a tangential and a radial component of velocity relative to said path from said second inlet opening to said outlet opening.

144. The improvement of claim 143 wherein said nozzles of said portion introduce an oxygen-containing gas at an angel of about 45 degrees relative to said path of said gasses.

145. The improvement of claim 144 wherein said nozzles of said portion introduce an oxygen-containing gas into said reburn section at an angle not greater than about 45 degrees relative to radial lines drawn from the center of said excitor means directly to the wall of said reburn unit.

146. The improvement of claim 143 wherein the space between said excitor means and the wall of said reburn unit near said inlet opening is less than near said outlet opening.

147. The improvement of claim 146 wherein the fluid within said reburn unit has a component of velocity in direction of said path from said second inlet opening to said second outlet opening of not greater than about 55 feet per second.

148. The improvement of claim 147 wherein said nozzles on said excitor means are arranged in rows relative to said path from said second inlet opening to said second outlet opening, with the nozzles of a particular one of said rows having a staggard configuration relative to the nozzles on the preceeding row and to the nozzles on the succeeding row.

149. The improvement of claim 148 wherein said component of velocity is not greater than about 46 feet per second.

150. The improvement of claim 147 wherein said space between said excitor means and said wall of said reburn unit has at least one sharp increase along said path.

151. The improvement of claim 147 wherein said space between said excitor means and said wall of said reburn unit increases gradually along at least a portion of said path from said second inlet opening to said second outlet opening.

152. The improvement of claim 139 including (a) a first support connected between said excitor means near said second inlet opening and said wall of said reburn unit and (b) a second support connected between said excitor means near said second outlet opening and said wall of said reburn unit, said first and second supports holding said excitor means within said reburn unit and a having hollow interior in fluid communication with said plenum in said excitor means and a substantially rectangular cross-section on planes parallel to said path from said second inlet opening to said second outlet opening, and wherein said oxygenating means introduces said oxygen-containing gas to said plenum in said excitor means through said first and second supports.

153. The improvement of claim 147 wherein the distance between said excitor means and the wall of said reburn unit at a particular location along the length of said excitor means is substantially equidistant around said excitor means.

154. The improvement of claim 153 wherein the space between said excitor means and said reburn unit, is substantially annular.

155. The improvement of claim 139 wherein the surface of said excitor means facing said interior of said reburn unit is composed of a material having a thermal conductivity constant k less than about $$\frac{60 \text{ Btu. in.}}{\text{hr. ft.2 °F.}}$$

where k is defined by $$k = \frac{gl}{AT}$$

where q is the heat conductivity in Btu/hr. through a surface of thickness 1 in inches, area A in square feet, and temperature T in °F.

156. The improvement of claim 155 wherein at least a portion of said nozzles on said excitor means introduce an oxygen-containing gas with both a tangential and a radial component of velocity relative to said path from said second inlet opening to said second outlet opening.

157. The improvement of claim 156 wherein the surface of said excitor means facing said interior is composed of a heat and corrosion resistant material and wherein k is not greater than about 24.

158. In a fume burning system for improving the environmental quality of a gaseous fluid emanating from the output of a source and containing combustible hydrocarbons comprising a reburn unit with:

(1) an inlet opening, coupled to and in fluid communication with said output;

(2) means forming an outlet opening for the egress of all of the gaseous products of combustion from said reburn unit;

(3) burner means, coupled to said reburn unit, for burning a fuel in said reburn unit; and (4) oxygenating means, coupled to said reburn unit, for introducing an oxygen-containing gas into said reburn unit, the improvement comprising choking means, coupled to said outlet opening, for selectively reducing the cross-sectional area of said outlet opening.

159. The improvement of claim 158 wherein said choking means can selectively reduce the cross-sectional area of said outlet opening to 60 percent of the maximum cross-sectional area of said outlet opening.

160. The improvement of claim 159 wherein said choking means is located at the end of said reburn unit.

161. The improvement of claim 158 further including (a) sensing means, coupled to said system, for determining a condition within said system and (b) choking control means, coupled to said sensing means and to said choking means for, in response to the condition determined by said sensing means, controlling the amount of the cross-sectional area of said outlet opening closed reduced by said choking means.

162. The improvement of claim 161 wherein said temperature sensing means is a temperature sensing means, coupled to said reburn unit, and said choking control means, when the temperature sensed by said temperature sensing means falls below a predetermined level, causes said choking means to reduce the cross-sectional areas of said outlet opening.

163. The improvement of claim 161 further including steam producing means coupled to said system for utilizing the heat of said system to convert water to steam, and wherein said sensing means is a pressure sensing means, coupled to said steam producing means, for determining the pressure of steam produced by said steam producing means, and said choking control means, when the steam pressure determined by said steam sensing means falls below a predetermined level, causes said choking means to reduce the cross-sectional area of said outlet opening.

164. The improvement of claim 161 wherein said choking means reduces the size of said outlet opening by blocking off one side of said outlet opening.

165. The improvement of claim 161 wherein said choking means is a butterfly choke damper.

166. The improvement of claim 161 further including (A) excitor means placed within, surrounded by, and coupled to said reburn unit, the majority of the length of said excitor means, in passing from said inlet opening to said outlet opening, being out of contact with the wall of said reburn unit, for reducing the cross-sectional area of said reburn unit on a plane transverse to the path passing from said inlet opening to said outlet opening and (B) a plurality of nozzle means, coupled to, in fluid communications with, and forming part of said oxygenating means, said nozzle means being connected to and arranged on the surface of said excitor means and being for introducing said oxygen-containing gas into the space between the inner surface of said reburn unit and said excitor means at a nonperpendicular angle to said path.

167. The improvement of claim 166 wherein at least a portion of said nozzles on said excitor means introduce said oxygen-containing gas with both a tangential and a radial component of velocity relative to said path from said inlet opening to said outlet opening.

168. The improvement of claim 167 further including nozzles located on the wall of said reburn unit in fluid communication with said oxygenating means and wherein said oxygenating means introduces said oxygen-containing gas into said reburn unit through said nozzles located on said excitor means and through said nozzles located on the walls of said reburn unit.

169. The improvement of claim 167 wherein said oxygenating means introduces said oxygen-containing gas only through said nozzles on said excitor means.

170. The improvement of claim 167 wherein the distance between said excitor means and the wall of said reburn unit at a particular location along the length of said excitor means is substantially equidistant around said excitor means.

171. The improvement of claim 170 wherein the space between said excitor means and said reburn unit is substantially annular.

172. The improvement of claim 170 wherein said excitor means includes a plenum in fluid communication with said oxygenating means and nozzles on the surface of said excitor means in fluid communication with said plenum and said oxygenating means and introduces said oxygenating-containing gas into said reburn unit through said nozzles.

173. The improvement of claim 172 wherein said plenum is a first plenum said oxygenating means includes a second plenum located on the exterior of said reburn unit and said oxygenating means passes said oxygen-containing gas through said second plenum prior to passing it into said reburn unit through said nozzles on said excitor means.

174. The improvement of claim 172 wherein the space between said excitor means and the wall of said reburn unit near said inlet opening is less than near said outlet opening.

175. The improvement of claim 174 wherein said space between said excitor means and said wall of said reburn unit has at least one sharp increase along said path.

176. The improvement of claim 174 wherein said space between said excitor means and said wall of said reburn unit increases gradually along at least a portion of said path from said inlet opening to said outlet opening.

177. The improvement of claim 172 including (a) a first support connected between said excitor means near said inlet opening and said wall of said reburn unit and (b) a second support connected between said excitor means near said outlet opening and said wall of said reburn unit, said first and second supports holding said excitor means and being within said reburn unit and having hollow interiors in fluid communication with said plenum in said excitor means substantially rectangular cross-section on planes parallel to said path from said inlet opening to said outlet opening, and wherein said oxygenating means introduces said oxygen-containing gas to said plenum in said excitor means through said first and second supports.

178. The improvement of claim 167 wherein the surface of said excitor means facing said interior is composed of a heat and corrosion resistant material.

179. The improvement of claim 178 wherein the surface of said excitor means facing said interior of said reburn unit is composed of a material having a thermal conductivity constant k less than about $$\frac{60 \text{ Btu. in.}}{\text{hr. ft.2 °F.}}$$

where k is defined by $$k = \frac{gl}{AT}$$

where q is the heat conductivity in Btu/hr. through a surface of thickness in inches, area A in square feet, and temperature T in ° F.

180. The improvement of claim 179 wherein the fluid within said reburn unit has a component of velocity in the direction of said path from said inlet opening to said outlet opening of not greater than about 46 feet per second.

181. The improvement of claim 167 wherein the surface of said excitor means facing said interior of said reburn unit is composed of a material having a thermal conductivity constant k less than about $$\frac{60 \text{ Btu. in.}}{\text{hr. ft.2 °F.}}$$

where k is defined by $$k = \frac{gl}{AT}$$

where q is the heat conductivity in Btu/hr. through a surface of thickness l in inches, area A in square feet, and temperature T in ° F.

182. The improvement of claim 181 wherein the fluid within said reburn unit has a component of velocity in the direction of said path from said outlet opening to said second outlet opening of not greater than about 46 feet per second.

183. The improvement of claim 166 wherein said choking means can reduce the cross-sectional area of said outlet opening up to 60 percent of the area of said outlet opening.

184. The improvement of claim 161 wherein said choking means can reduce the cross-sectional area of said second opening up to 60 percent of the area of said outlet opening.

185. In a fume burning system for improving the environmental quality of a gaseous fluid emanating from the output of a source and containing combustible hydrocarbons comprising a reburn unit with:

(1) an inlet opening, coupled to and in fluid communication with said output;
(2) an outlet opening for the egress of the gaseous products of combustion from said reburn unit;
(3) burner means, coupled to said reburn unit, for burning a fuel in said reburn unit; and
(4) oxygenating means, coupled to said reburn unit, for introducing an oxygen-containing gas into said reburn unit, the improvement comprising (a) excitor means, coupled to, placed within, and surrounded by said reburn unit, the majority of the length of said excitor means, in passing from said inlet opening to said outlet opening, being out of contact with the wall of said reburn unit, said excitor means being for reducing the cross-sectional area of the interior of said reburn unit on a plane transverse to the path passing from said inlet opening to said outlet opening, the surface of said excitor means facing said interior being composed of a heat and corrosion resistant material, (b) nozzles arranged on said excitor means, said oxygenating means coupling to said oxygenating means and introducing said oxygen-containing gas into said reburn unit through said nozzles, (c) a first support connected between said excitor means near said inlet opening and said wall of said reburn unit, and (d) a second support connected between said excitor means near said outlet opening and said wall of said reburn unit, said first and second supports holding said excitor means within said reburn unit and having hollow interiors in fluid communication with said plenum in said excitor means and a substantially rectangular cross-section on planes parallel to said path from said inlet opening to said outlet opening, and wherein said oxygenating means introduces said oxygen-containing gas to said excitor means through said first and second supports.

186. The improvement of claim 185 further including cooling means, coupled to excitor means, for reducing the temperature of said excitor means.

187. The improvement of claim 186 wherein said oxygenating means includes a plenum located on the exterior of said reburn unit and said oxygenating means passes said oxygen-containing gas through said plenum prior to passing it into said reburn unit through said nozzles on said excitor means.

188. The improvement of claim 187 wherein said nozzles on said excitor means are arranged in rows relative to said path from said inlet opening to said outlet opening with the nozzles of a particular one of said rows having a staggered configuration relative to the nozzles on the preceeding row and to the nozzles on the succeeding row.

189. The improvement of claim 187 wherein the distance between said excitor means and said reburn unit at a particular location along the length of said excitor means is substantially equidistant around said excitor means.

190. The improvement of claim 189 wherein said space between said excitor means and said wall of said reburn unit has at least one sharp increase along said path.

191. The improvement of claim 189 wherein said space between said excitor means and said wall of said reburn unit increases gradually along at least a portion of said path from said second inlet opening to said second outlet opening.

192. The improvement of claim 187 wherein the surface of said excitor means facing said interior of said reburn unit is composed of a material having a thermal conductivity constant k less than about $$\frac{60 \text{ Btu. in.}}{\text{hr. ft.2 °F.}}$$

where k is defined by $$k = \frac{gl}{AT}$$

where q is the heat conductivity in Btu/hr. through a surface of thickness l in inches, area A in square feet, and temperature T in ° F.

193. The improvement of claim 192 wherein k is not greater than about 24.

194. In a fume burning system for improving the environmental quality of a gaseous fluid emanating from the output of a source and containing combustible hydrocarbons comprising a reburn unit with:

(1) an inlet opening, coupled to and in fluid communication with said output;
(2) an outlet opening for the egress of the gaseous products of combustion from said reburn unit;
(3) burner means, coupled to said reburn unit, for burning a fuel in said reburn unit; and
(4) oxygenating means, coupled to said reburn unit, for introducing an oxygen-containing gas into said reburn unit, the improvement comprising excitor means, coupled to, placed within, and surrounded by said reburn unit, the majority of the length of said excitor means, in passing from said inlet opening to said outlet opening being out of contact with the wall of said reburn unit, said excitor means being for reducing the cross-sectional area of the interior of said reburn unit on a plane transverse to the path passing from said inlet opening to said outlet opening, the surface of said excitor means facing said interior and being composed of a material having a thermal conductivity constant k less than $$\frac{60 \text{ Btu. in.}}{\text{hr. ft.2 °F.}}$$

where k is defined by $$k = \frac{gl}{AT}$$

where q is the heat conductivity in Btu/hr. through a surface of thickness l in inches, area A in square feet, and temperature T in ° F.

195. The improvement of claim 194 further including cooling means, coupled to said excitor means, for reducing the temperature of said excitor means.

196. The improvement of claim 195 further including nozzles arranged on said excitor means and in fluid communications with said oxygenating means when said oxygenating means and introduces said oxygenating-containing gas into said reburn unit through said nozzles.

197. The improvement of claim 196 wherein said oxygenating means includes a plenum located on the exterior of said reburn unit and said oxygenating means passes said oxygen-containing gas through said plenum prior to passing it into said reburn unit through said nozzles on said excitor means.

198. The improvement of claim 197 wherein said nozzles on said excitor means are arranged in rows in said path from said inlet opening to said outlet opening with the nozzles of a particular one of set rows having a staggard configuration relative to the nozzles on the preceeding row and to the nozzles on the succeeding row.

199. The improvement of claim 197 including (a) a first support connected between said excitor means near said inlet opening and said wall of said reburn unit and (b) a second support connected between said excitor means near said outlet opening and said wall of said reburn unit, said first and second supports holding said excitor means within said reburn unit and having hollow interiors in fluid communication with said plenum in said excitor means and a substantially rectangular cross-section on planes parallel to said path from said inlet opening to said outlet opening, and wherein said oxygenating means introduces said oxygen-containing gas to said plenum in said excitor means through said first and second supports.

200. The improvement of claim 197 wherein the distance between said excitor means and the wall of said reburn unit at a particular location along the length of said excitor means is substantially equidistant around said excitor means.

201. The improvement of claim 200 wherein said space between said excitor means and said wall of said reburn unit has at least one sharp increase along said path.

202. The improvement of claim 200 wherein said space between said excitor means and said wall of said reburn unit increases gradually along at least a portion of said path from said second inlet opening to said second outlet opening.

203. The improvement of claim 197 wherein k is not greater than about 24.

204. A method of incinerating refuse which comprises:

(A) placing bulk refuse through a first inlet opening into a main incinerator chamber;

(B) burning said bulk refuse to produce gaseous combustion products;

(C) passing the gaseous combustion products out of said main combustion chamber through a first outlet opening and directly into (a) a second inlet opening of a first reburn section and (b) a third inlet opening of a second reburn section;

(D) burning a fuel in said first and second reburn sections;

(E) introducing an amount of an oxygen-containing gas into said first and second reburn sections;

(F) passing the gaseous combustion products out of said first and second reburn sections through second and third outlet openings respectively.

205. The method of claim 204 further including closing off one of said reburn sections.

206. The method of claim 205 wherein said first reburn stages is composed of first and second reburn stages and said second reburn section is composed of third and fourth reburn stages with said first and third reburn stages being adjacent to said second and third inlet openings and said second and fourth reburn stages being adjacent to said second and third outlet openings and further including measuring first and second temperatures within or near proximity to the interiors of said first and third reburn stages, respectively, burning greater amounts of said fuel in said first and third reburn chambers when said first and second temperatures are below first and second predetermined set points, respectively, and lesser amounts when said first and second temperatures are above said first and second set points, respectively, measuring third and fourth temperatures within or near proximity to the interior of said first and third reburn stages, increasing the amounts of said oxygen-containing gas introduced into said first and third reburn stages when said third and fourth temperatures are above third and fourth predetermined set points, respectively, and lesser amounts of said oxygen-containing gas when said third and fourth temperatures are below said third and fourth set points, respectively, measuring fifth and sixth temperatures within or in near proximity to the interiors of said second and fourth reburn stages, and introducing a greater amount of said oxygen-containing gas into said second and fourth reburn stages when said fifth and sixth temperatures are above fifth and sixth set points, respectively, and reducing the amount of said oxygen-containing gas introduced into said second and fourth reburn stages when said fifth and sixth temperatures are below said fifth and sixth predetermined set points, respectively.

207. The method of claim 206 further including sensing a condition within said first or second reburn sections and, in response to said condition sensed, opening or closing said third inlet opening.

208. The method of claim 207 further including removing heat energy from said main chamber and transporting it in a form useful to another location.

209. The method of claim 205 further including closing off at least a portion of said third outlet opening.

210. The method of claim 209 further including introducing an oxygen-containing gas into said main chamber, sensing a condition in the incinerator system composed of said main chamber and said first and second reburn sections, and changing the amount of said oxygen-containing gas introduced into said main chamber dependent upon said sensed determined in said system.

211. The method of claim 209 wherein said first reburn stages is composed of first and second reburn stages and said second reburn section is composed of third and fourth reburn stages with said first and third reburn stages being adjacent to said second and third inlet openings and said second and fourth reburn stages being adjacent to said second and third outlet openings and further including measuring first and second temperatures within or near proximity to the interiors of said first and third reburn stages, respectively, burning greater amounts of said fuel in said first and third reburn chambers when said first and second temperatures are below first and second predetermined set points, respectively, and lesser amounts when said first and second temperatures are above said first and second set points, respectively, measuring third and fourth temperatures within or near proximity to the interior of said first and third reburn stages, increasing the amounts of said oxygen-containing gas introduced into said first and third reburn stages when said third and fourth temperatures are above third and fourth predetermined set points, respectively, and lesser amounts of said oxygen-containing gas when said third and fourth temperatures are below said third and fourth set points, respectively, measuring fifth and sixth temperatures within or in near proximity to the interiors of said second and fourth reburn stages, and introducing a greater amount of said oxygen-containing gas into said second and fourth reburn stages when said fifth and sixth temperatures are above fifth and sixth set points, respectively, and reducing the amount of said oxygen-containing gas introduced into said second and fourth reburn stages when said fifth and sixth temperatures are below said fifth and sixth predetermined set points, respectively.

212. The method of claim 211 further including reducing the cross-sectional area of said third outlet opening.

213. The method of claim 209 further including sensing a condition in the system comprising said main chamber and said first and second reburn sections and, in response to said condition sensed in said system, changing the amount of the cross-sectional area of said third outlet opening closed off.

214. The method of claim 213 wherein said condition determined in said system is the temperature of said first and second reburn sections and, once said temperature falls below a predetermined value, said third inlet opening is closed and, once said temperature raises above said predetermined value, said third inlet opening is opened.

215. The method of claim 213 including closing off at least about 60 percent of at least one of said second or said third outlet openings.

216. The method of claim 213 further including closing off at least a portion of both said second and said third outlet openings.

217. The method of claim 205 wherein said fumes, after being passed into said second and third inlet openings of said first and second reburn sections, are passed around, respectively, first and second excitor means placed within, surrounded by, and coupled to said first and second reburn sections, respectively, the majority of the lengths of said first and second excitor means, in passing from said second and third inlet openings to said second and third outlet openings, respectively, being out of contact with the walls of said first and second reburn sections, respectively.

218. The method of claim 217 wherein said oxygen-containing gas is introduced into said first and second reburn sections through said first and second excitor means, respectively.

219. The method of claim 218 wherein said oxygen-containing gas, before being introduced into said first and second excitor means, is passed around the exterior of said first and second reburn sections, respectively.

220. The method of claim 218 wherein said oxygen-containing gas is introduced into said first and second reburn sections at an angle that is nonperpendicular to the path from said second and third inlet openings to said second and third outlet openings, respectively.

221. The method of claim 220 wherein said oxygen-containing gas is introduced into said first and second reburn sections with a nonzero tangetial component of velocity relative to said paths in said first and second reburn sections, respectively.

222. The method of claim 209 wherein said fumes, after being passed into said second and third inlet openings of said first and second reburn sections, are passed around, respectively, first and second excitor means placed within, surrounded by, and coupled to said first and second reburn sections, respectively, the majority of the length of said first and second excitor means, in passing from said second and third said inlet openings to said second and third outlet openings, respectively, being out of contact with the walls of said first and second reburn sections, respectively.

223. The method of claim 222 further including sensing a condition in the system comprising said main chamber and said first and second reburn sections and, in response to said condition determined in said system, changing the amount of the cross-sectional area of said third outlet opening closed off.

224. The method of claim 223 wherein said oxygen-containing gas is introduced into said first and second reburn sections through first and second excitor means placed in the interior of said first and second reburn sections, respectively.

225. The method of claim 224 wherein said oxygen-containing gas is introduced into said first and second reburn sections at an angle that is nonperpendicular to the path from said second and third inlet openings to said second and third outlet openings, respectively.

226. The method of claim 225 wherein said oxygen-containing gas is introduced into said first and second reburn sections with a nonzero tangential component of velocity relative to said paths in said first and second reburn sections, respectively.

227. The method of claim 226 further including sensing a condition within said first or second reburn units and, in response to said condition sensed, opening or closing said third inlet opening.

228. A method of incinerating refuse which comprises:

(A) placing bulk refuse through a first inlet opening into a main incinerator chamber;

(B) burning said bulk refuse to produce gaseous combustion products;

(C) passing the gaseous combustion products out of said main combustion chamber through a first outlet opening and directly into a second inlet opening of a reburn unit;

(D) while in said reburn unit, passing said gaseous combustion products around an excitor placed within, surrounded by, and coupled to said reburn unit with the majority of the length of said excitor, in passing from said second inlet opening to a second outlet opening, through which the gaseous combustion products can egress from said reburn unit, being out of contact with the wall of said reburn unit;

(E) burning a fuel in said reburn unit;

(F) introducing into the space between the inner surface of said reburn unit and said excitor at a nonperpendicular angle to the direction of flow of gas through said space and with a component of motion in the direction from said second inlet opening to said second outlet opening an amount of an oxygen-containing gas into said reburn unit through a plurality of nozzles connected to and arranged on the surface of said excitor;

(G) passing the gaseous combustion products out of said reburn unit through said second outlet opening.

229. The method of claim 228 further including cooling said excitor means.

230. The method of claim 229 wherein said oxygen-containing gas is introduced into said first and second reburn unit through said excitor means.

231. The method of claim 230 wherein said oxygen-containing gas, before being introduced into said reburn unit through said excitor means, is passed around the exterior of said reburn unit.

232. The method of claim 231 wherein said oxygen-containing gas is introduced into said reburn sections with a nonzero tangential component of velocity relative to said path in said reburn unit.

233. The method of claim 230 wherein said oxygen-containing gas is introduced into said reburn unit with a nonzero tangential component of velocity relative to said path in said reburn unit.

234. A method of incinerating refuse which comprises:

(A) placing bulk refuse through a first inlet opening into a main incinerator chamber;

(B) burning said bulk refuse to produce gaseous combustion products;

(C) passing the gaseous combustion products out of said main combustion chamber through a first outlet opening and directly into a second inlet opening of a reburn unit;

(D) burning a fuel in said reburn unit;

(E) introducing an amount of an oxygen-containing gas into said reburn unit;

(F) passing all of the gaseous combustion products out of said reburn unit through a second outlet opening; and (G) selectively reducing the cross-sectional area of said second outlet opening.

235. The method of claim 234 further including introducing an oxygen-containing gas into said main chamber, sensing a condition in the incinerator system composed of said main chamber and said reburn unit, and changing the amount of said oxygen-containing gas introduced into said main chamber dependent upon said condition sensed in said system.

236. The method of claim 235 wherein said reburn unit is composed of first and second reburn stages with said first reburn stage being adjacent to said second inlet opening and said second reburn stage being adjacent to said second outlet opening and further including measuring a first temperature within or near proximity to the interior of said first reburn stage, burning a greater amount of said fuel in said first reburn stage when said first temperature is below a first predetermined set point and a less amount when said first temperature is above said first set point, measuring a second temperature within or near proximity to the interior of said first reburn stage, increasing the amount of said oxygen-containing gas introduced into said first reburn stage, when said second temperature is above a second predetermined set point and a lesser amount of said oxygen-containing gas when said temperature is below said second predetermined set point, measuring a third temperature within or in near proximity to the interior of said second reburn stage; and introducing a greater amount of said oxygen-containing gas into said second reburn stage when said third temperature is above a third predetermined set point and reducing the amount of said oxygen-containing gas introduced into said second reburn stage when said third temperature is below said third set point.

237. The method of claim 236 further including reducing the cross-sectional area of said second outlet opening.

238. The method of claim 237 further including sensing a condition in the system comprising said main chamber and said reburn unit and, in response to said condition determined with said system, changing the amount of the cross-sectional area of said second outlet opening closed off.

239. The method of claim 238 wherein said oxygen-containing gas is introduced into said reburn unit at an angle that is nonperpendicular to the path from said second inlet opening to said second outlet opening.

240. The method of claim 239 wherein said oxygen-containing gas is introduced into said reburn unit with a nonzero tangential component of velocity relative to said path in said reburn unit.

241. The method of claim 240 wherein said oxygen-containing gas is introduced into said reburn unit through an excitor means placed in the interior of said reburn unit.

242. The method of claim 241 wherein said oxygen-containing gas, before being introduced into said excitor means, is passed around the exterior of said reburn unit.

243. The method of claim 239 including closing off at least about 60 percent of said second outlet opening.

244. The method of claim 238 including closing off at least about 60 percent of said second outlet openings.

245. A method of burning fumes emanating from the output of a source comprising:

(A) passing said fumes from said output directly into a inlet opening of a first reburn section and a second inlet opening of a second reburn section;

(B) burning a fuel in said first and second reburn sections;

(C) introducing an amount of an oxygen-containing gas into said first and second reburn sections; and (D) passing the gaseous combustion products out of said first and second reburn sections through first and second outlet openings, respectively.

246. The method of claim 245 further including closing off one of said reburn sections.

247. The method of claim 246 wherein said first reburn stages is composed of first and second reburn stages and said second reburn section is composed of third and fourth reburn stages with said first and third reburn stages being adjacent to said second and third inlet openings and said second and fourth reburn stages being adjacent to said second and third outlet openings and further including measuring first and second temperatures within or near proximity to the interiors of said first and third reburn stages, respectively, burning greater amounts of said fuel in said first and third reburn chambers when said first and second temperatures are below first and second predetermined set points, respectively, and lesser amounts when said first and second temperatures are above said first and second set points, respectively, measuring third and fourth temperatures within or near proximity to the interior of said first and third reburn stages, increasing the amounts of said oxygen-containing gas introduced into said first and third reburn stages when said third and fourth temperatures are above third and fourth predetermined set points, respectively, and lesser amounts of said oxygen-containing gas when said third and fourth temperatures are below said third and fourth set points, respectively, measuring fifth and sixth temperatures within or in near proximity to the interiors of said second and fourth reburn stages, and introducing a greater amount of said oxygen-containing gas into said second and fourth reburn stages when said fifth and sixth temperatures are above fifth and sixth set points, respectively, and reducing the amount of said oxygen-containing gas introduced into said second and fourth reburn stages when said fifth and sixth temperatures are below said fifth and sixth predetermined set points, respectively.

248. The method of claim 247 further including sensing a condition within said first or second reburn sections and, in response to said condition sensed opening or closing said second inlet opening.

249. The method of claim 246 further including closing off at least a portion of said second outlet opening.

250. The method of claim 249 wherein said first reburn stages is composed of first and second reburn stages and said second reburn section is composed of third and fourth reburn stages with said first and third reburn stages being adjacent to said second and third inlet openings and said second and fourth reburn stages being adjacent to said second and third outlet openings and further including measuring first and second temperatures within or near proximity to the interiors of said first and third reburn stages, respectively, burning greater amounts of said fuel in said first and third reburn chambers when said first and second temperatures are below first and second predetermined set points, respectively, and lesser amounts when said first and second temperatures are above said first and second set points, respectively, measuring third and fourth temperatures within or near proximity to the interior of said first and third reburn stages, increasing the amounts of said oxygen-containing gas introduced into said first and third reburn stages when said third and fourth temperatures are above third and fourth predetermined set points, respectively, and lesser amounts of said oxygen-containing gas when said third and fourth temperatures are below said third and fourth set points, respectively, measuring fifth and sixth temperatures within or in near proximity to the interiors of said second and fourth reburn stages, and introducing a greater amount of said oxygen-containing gas into said second and fourth reburn stages when said fifth and sixth temperatures are above fifth and sixth set points, respectively, and reducing the amount of said oxygen-containing gas introduced into said second and fourth reburn stages when said fifth and sixth temperatures are below said fifth and sixth predetermined set points, respectively.

251. The method of claim 250 further including reducing the cross-sectional area of said second outlet opening.

252. The method of claim 251 further including sensing a condition in the system comprising said first and second reburn sections and, in response to said condition sensed in said system, changing the amount of the cross-sectional area of said second outlet opening closed off.

253. The method of claim 252 wherein said condition determined in said system is the temperature of said first and second reburn sections and, once said temperature falls below a predetermined value, said second inlet opening is closed and, once said temperature raises above said predetermined value said second inlet opening is opened.

254. The method of claim 252 including closing off at least about 60 percent of at least one of said first or said second outlet openings.

255. The method of claim 252 further including closing off at least a portion of both said first and second outlet openings.

256. The method of claim 245 wherein, said fumes, after being passed into said first and second inlet openings of said first and second reburn sections, are passed around, respectively, first and second excitor means placed within, surrounded by, and coupled to said first and second reburn sections, respectively, the majority of the length of said first and second excitor means, in passing from said first and second said inlet openings to said first and second second outlet openings, respectively, being out of contact with the walls of said first and second reburn sections, respectively.

257. The method of claim 256 wherein said oxygen-containing gas is introduced into said first and second reburn sections through said first and second excitor means, respectively.

258. The method of claim 257 wherein said oxygen-containing gas, before being introduced into said first and second excitor means, is passed around the exterior of said first and second reburn sections, respectively.

259. The method of claim 257 wherein said oxygen-containing gas is introduced into said first and second reburn sections at an angle that is nonperpendicular to the path from said first and second inlet openings to said first and second outlet openings, respectively.

260. The method of claim 259 wherein said oxygen-containing gas is introduced into said first and second reburn sections with a nonzero tangential component of velocity relative to said paths in said first and second reburn sections, respectively.

261. The method of claim 246 wherein said fumes after being passed into said first and second inlet openings of said first and second reburn sections, are passed around, respectively, first and second excitor means placed within, surrounded by, and coupled to said first and second reburn sections, respectively, the majority of the length of said first and second excitor means, in passing from said first and second said inlet openings to said first and second outlet openings, respectively, being out of contact with the walls of said first and second reburn sections, respectively.

262. The method of claim 261 further including sensing a condition in the system comprising said first and second reburn units and, in response to said condition sensed in said system, changing the amount of the cross-sectional area of said second outlet opening closed off.

263. The method of claim 262 wherein said oxygen-containing gas is introduced into said first and second reburn sections through said first and second excitor means, respectively.

264. A method of burning fumes emanating from the output of a source comprising:

(A) passing said fumes from said output directly into an inlet opening of a reburn unit;

(B) while in said reburn unit, passing said fumes around an excitor placed within, surrounded by, and coupled to said reburn unit with the majority of the length of said excitor, in passing from said inlet opening to an outlet opening through which the gaseous combustion products can egress from said reburn unit, being out of contact with the wall of said reburn unit;

(C) burning a fuel in said reburn unit;

(D) introducing into the space between the inner surface of said reburn unit and said excitor at a nonperpendicular angle to the path of the flow of gas through said space and with a component of motion in the direction from said inlet opening to said outlet opening an amount of an oxygen-containing gas into said reburn unit through a first plurality of nozzles connected to and arranged on the surface of said excitor; and (E) passing the gaseous combustion products out of said reburn unit.

265. The method of claim 264 further including cooling said excitor means.

266. The method of claim 265 wherein said oxygen-containing gas is introduced into said reburn unit through said excitor means.

267. The method of claim 266 wherein said oxygen-containing gas, before being introduced into said reburn unit through said excitor means, is passed around the exterior of said reburn unit.

268. The method of claim 267 wherein said oxygen-containing gas is introduced into said reburn unit with a nonzero tangential component of velocity relative to said path in said reburn unit.

269. The method of claim 266 wherein said oxygen-containing gas is introduced into said reburn unit with a nonzero tangential component of velocity relative to said path in said reburn unit.

270. A method of burning fumes emanating from the output of a source comprising:

(A) passing said fumes from said output directly into an inlet opening of a reburn unit;

(D) burning a fuel in said reburn unit;

(E) introducing an amount of an oxygen-containing gas into said reburn unit;

(F) passing all of the gaseous combustion products out of said reburn unit through an outlet opening; and (G) selectively reducing the cross-sectional area of said outlet opening.

271. The method of claim 270 wherein said reburn unit is composed of first and second reburn stages with said first reburn stage being adjacent to said inlet opening and said second reburn stage being adjacent to said outlet opening and further including measuring a first temperature within or near proximity to the interior of said first reburn stage, burning a greater amount of said fuel in said first reburn stage when said first temperature is below a first predetermined set point and a less amount when said first temperature is above said first set point, measuring a second temperature within or near proximity to the interior of said first reburn stage, increasing the amount of said oxygen-containing gas introduced into said first reburn stage when said second temperature is above a second predetermined set point and a lesser amount of said oxygen-containing gas when said temperature is below said second predetermined set point, measuring a third temperature within or in near proximity to the interior of said second reburn stage, and introducing a greater amount of said oxygen-containing gas into said second reburn stage when said third temperature is above a third predetermined set point and reducing the amount of said oxygen-containing gas introduced into said second reburn stage when said third temperature is below said third set point.

272. The method of claim 271 further including reducing the cross-sectional area of said outlet opening.

273. The method of claim 272 further including sensing a condition in said reburn unit and, in response to said condition determined with said unit, changing the amount of the cross-sectional area of said outlet opening closed off.

274. The method of claim 273 wherein said oxygen-containing gas is introduced into said reburn unit at an angle that is nonperpendicular to the path from said inlet opening to said outlet opening.

275. The method of claim 274 wherein said oxygen-containing gas is introduced into said reburn unit with a nonzero tangential component of velocity relative to said path in said reburn unit.

276. The method of claim 275 wherein said oxygen-containing gas is introduced into said reburn unit through an excitor means placed in the interior of said reburn unit.

277. The method of claim 276 wherein said oxygen-containing gas, before being introduced into said excitor means, is passed around the exterior of said reburn unit.

278. The method of claim 274 including closing off at least about 60 percent of said second outlet opening.

279. The method of claim 273 including closing off at least about 60 percent of said second outlet opening.

* * * * *